US009181062B2

(12) United States Patent
Batrin et al.

(10) Patent No.: US 9,181,062 B2
(45) Date of Patent: Nov. 10, 2015

(54) TRIM ARM ADJUSTMENT ASSEMBLY AUTOMATED SETTING

(71) Applicant: Alliance Machine Systems International, LLC, St. Louis, MO (US)

(72) Inventors: Marius D. Batrin, Liberty Lake, WA (US); Curtis A. Roth, Post Falls, ID (US)

(73) Assignee: Alliance Machine Systems International, LLC, St. Louis, MO (US)

( * ) Notice: Subject to any disclaimer, the term of this patent is extended or adjusted under 35 U.S.C. 154(b) by 0 days.

(21) Appl. No.: 14/447,188

(22) Filed: Jul. 30, 2014

(65) Prior Publication Data

US 2015/0090559 A1 Apr. 2, 2015

Related U.S. Application Data

(60) Provisional application No. 61/860,152, filed on Jul. 30, 2013.

(51) Int. Cl.

| | |
|---|---|
| ***B65H 35/00*** | (2006.01) |
| ***B65B 11/00*** | (2006.01) |
| ***B65H 29/00*** | (2006.01) |
| ***B26F 1/00*** | (2006.01) |

(52) U.S. Cl.
CPC *B65H 35/00* (2013.01); *B26F 1/00* (2013.01); *B65B 11/00* (2013.01); *B65H 29/00* (2013.01)

(58) Field of Classification Search
CPC ..... B26F 1/00; B65H 35/00; B26D 1/40
USPC ..... 493/83
See application file for complete search history.

(56) References Cited

U.S. PATENT DOCUMENTS

| | | | | |
|---|---|---|---|---|
| 4,740,193 | A * | 4/1988 | Frost et al. | 493/82 |
| 6,966,245 | B1 * | 11/2005 | Simpson | 83/27 |
| 7,100,484 | B2 * | 9/2006 | Maddalon | 83/74 |
| 7,326,168 | B2 * | 2/2008 | Kocherga et al. | 493/463 |
| 7,762,537 | B2 * | 7/2010 | Kato et al. | 270/37 |
| 9,045,243 | B2 * | 6/2015 | Brown et al. | 1/1 |

* cited by examiner

*Primary Examiner* — Gene Crawford
*Assistant Examiner* — Thomas Randazzo
(74) *Attorney, Agent, or Firm* — Thompson Coburn LLP

(57) ABSTRACT

Techniques for automatically setting trim removal or stacking device arms. One point on a trim arm (such as an end) is attached to a transverse rail, along which that end moves, and provides an anchor point to which the trim arm can be angled. An automated device anchors that end of the trim arm, and locks it in place at a position designated by an operator. A skew adjustment pin couples to a second point on the trim arm, so that adjusting the position of the adjustment pin skews the trim arm's angle. An automated device anchors that second point of the trim arm, and locks it in place at a angle designated by an operator. A control system electronically measures the location of the first anchor point, and directs positioning devices to move trim arms, skew them, and lock or unlock those settings.

20 Claims, 18 Drawing Sheets

TRIM ARM ADJUSTMENT ASSEMBLY AUTOMATED SETTING

CROSS REFERENCE TO RELATED APPLICATIONS

This application claims the benefit of priority under 35 U.S.C. §119 (e) from U.S. Provisional Application Ser. No. 61/860,152 filed on Jul. 30, 2013, the contents of which are incorporated by reference herein in their entirety.

BACKGROUND

1. Field of the Disclosure

This application generally relates to automatic setting of arms in a trim removal or stacking device, and other matters.

2. Background of the Disclosure

Sheet fed production lines generally operate on substantially flat sheets that are relatively thin with respect to their width, such as paper, cardboard, corrugated cardboard, thin plastics, thin wooden boards, and other materials. For example, the sheets might flow through a rotary die cutter (RDC), which perforates or semi-perforates the sheets. The cut sheets might flow through a stacker, which helps remove any excess pieces (sometimes known as "trim removal"), separates the sheets into separate flows, and stacks and possibly binds them for transport.

It sometimes occurs that it is desirable to separate the sheets into separate streams, such as spreading them out horizontally, after they exit the stacker. For example, as the sheets undergo trim removal, they also can be separated into streams with distinct interstitial distance. This can be usefully performed in the trim removal section, which captures the sheets as they flow from the rotary die cutter, and which includes multiple arms (sometimes known as "trim arms") that can be adjusted to separate the sheets as trim is removed.

Some known systems provide for manual adjustment of trim arms, such as by an operator of the device. One or more operators might set each arm in position to support and capture the sheets, and to adjust their angle of travel with the effect of separating them into individual streams. This process is inefficient. Further, it sometimes occurs that the operators misalign the trim arms, with the effect that the trim arms can fail to support the sheets, fail to adequately control the sheets, or fail to accurately separate the sheets.

Other known systems provide for support and trim removal in a first section of the flow, and separation of the sheets into distinct streams in a second section of the flow. In such systems, the second section would be separately adjusted, with the effect that a separate section, such as an incline conveyor, is involved with adjusting the angle of travel of the sheets. It sometimes occurs that the length of the separate section (such as the incline conveyor) can be inconvenient or pose undesirable or excessive draw on available space.

Other known systems provide for separate adjustment of each end of the trim arms, offsetting them to provide a skew that adjusts the angle of travel of the sheets. In such systems, this can involve two separate mechanisms to find both ends of each arm and to offset them properly. It sometimes occurs that these systems are slower and less reliable.

Each of these examples, as well as other possible considerations, can cause difficulty in aspects of a skewing function being applied to separate the sheets (such as in a trim removal section), particularly in those cases in which careful alignment is desired, or in those cases in which changes of alignment are desired. Similarly, each of these examples, as well as other possible considerations, can cause difficulty in aspects of an automatic trim arm setting system, particularly in those cases in which there is an advantage to maintaining the flexibility of adjusting alignment, and the relatively reduced expense of stopping the flow to make adjustments.

BRIEF SUMMARY OF THE DISCLOSURE

This application provides apparatuses and techniques that provide automatic setting of arms in a trim removal or stacking device, and other capabilities.

In one embodiment, a trim removal device includes a transverse rail, to which one end of each trim arm is attached, and along which that end of each trim arm can be moved in a direction generally transverse to the flow through the rotary die cutter. For each trim arm, the rail provides a first anchor point to which the trim arm can be coupled, and from which the trim arm can be angled. For a first example, the trim removal device can include an automated trim arm anchoring device, capable of setting the first anchor point of each trim arm at a position designated by an operator (or designated by a program selected by an operator). For a second example, the trim removal device can include a first locking device, capable of locking the first anchor point of each trim arm against movement, once that first anchor point has been set.

In one embodiment, one or more trim arms include a skew adjustment pin, to which a second part of the trim arm is attached, and across which that second part of the trim arm can be moved, also transverse to the flow through the rotary die cutter (within an offset range). For each trim arm, the skew adjustment pin provides a second anchor point to which the trim arm can be coupled, and whose offset position provides a skew angle between the first anchor point and the second anchor point. For a first example, the trim removal device can include an automatic trim arm offset-setting device, capable of setting the skew adjustment pin at skew angle designated by an operator (or designated by a program selected by an operator). For a second example, the trim removal device can include a second locking device, capable of locking the skew adjustment pin of each trim arm against movement, once that skew adjustment pin has been set.

In one embodiment, a control system is disposed to position the first anchor point and the second anchor point for one or more trim arms. For a first example, the control system can electronically measure the location of the first anchor point for the trim arm, with the effect that the control system does not have to rely on operator entry of data or operator positioning of the trim arm. For a second example, the control system can direct the movement of one or more positioning devices to set and lock, or unlock and set, the position of one or more trim arms.

In one embodiment, only one positioning device is needed, although more than one can be provided. The positioning device (sometimes herein called a "shuttle") can move in a direction generally transverse to the rotary die cut flow, selecting one or more trim arms in turn. The shuttle can also move in a direction generally parallel to the rotary die cut flow, selecting or deselecting each trim arm in turn. For example, the shuttle can be disposed to select the first anchor point for a trim arm when closer to the rotary die cutter along the trim arm, and the skew adjustment pin for the trim arm when further from the rotary die cutter along the trim arm. The first anchor point can have a first locking mechanism that prevents its further movement without being so directed by the control system. Similarly, the second anchor point can have a second locking mechanism (not necessarily the same as the first locking mechanism) that prevents its further movement without being so directed by the control system.

In one embodiment, the control system includes a programmable logic device that is responsive to instructions and to operator inputs. For a first example, an operator can direct the control system to position the first anchor point and the second anchor point for each trim arm. For a second example, the operator can direct the control system to execute a first program, which includes instructions directing the control system to position the first anchor point and the second anchor point for each trim arm, such as at preselected locations and angles. For a third example, the control system can execute a second program, which includes instructions directing the control system to determine a set of locations and angles at which to position the trim arms, and to position the first anchor point and the second anchor point for each trim arm accordingly.

In such embodiments, the control system can send control signals, such as using control circuitry or mechanisms, to devices in the system, such as the following: The control system can direct the shuttle to select one or more trim arms in turn. The control system can position that trim arm's first anchor point. The control system can direct the shuttle to anchor that trim arm to the selected first anchor point. The control system can direct the shuttle to position that trim arm's second anchor point. The control system can direct the shuttle to anchor that trim arm to the selected second anchor point. The control system can direct the shuttle to repeat this method until up to all trim arms have been positioned and angled as selected.

After reading this application, those skilled in the art would recognize that techniques shown in this application are applicable to skew angling of trim arms at more than one location on the trim arm, and to fields other than movement and skew angling of trim arms. Moreover, after reading this application, those skilled in the art would recognize that techniques shown in this application are applicable to methods and systems other than those involving rotary die cut systems. In the context of the invention, there is no particular requirement for any such limitations.

While multiple embodiments are disclosed, including variations thereof, still other embodiments of the present disclosure will become apparent to those skilled in the art from the following detailed description, which shows and describes illustrative embodiments of the disclosure. As will be realized, the disclosure is capable of modifications in various obvious aspects, all without departing from the spirit and scope of the present disclosure. Accordingly, the drawings and detailed description are to be regarded as illustrative in nature and not restrictive.

DETAILED DESCRIPTION

Overview of Sheet Flow

Figure 1:
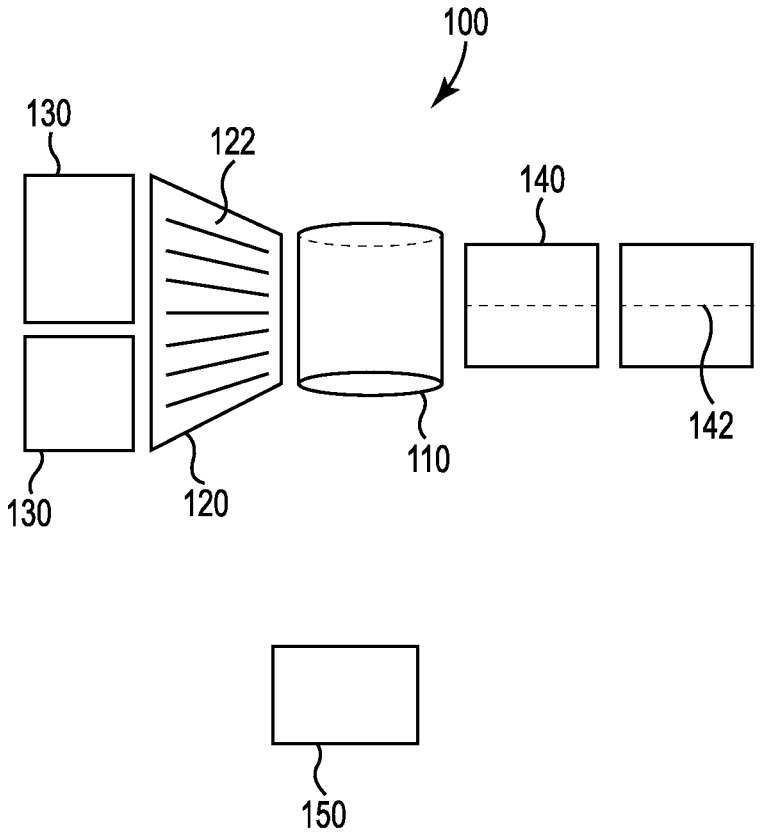
FIG. 1 shows a conceptual drawing of sheet flow through a rotary die cutter and trim removal section.

FIG. 1 shows a conceptual drawing of sheet flow through a rotary die cutter and trim removal section.

A system 100 includes elements shown in the figure, including at least a rotary die cutter 110, a trim removal section 120, one or more stacking or receiving elements 130, a set of sheets 140 flowing through the system 100, and a control element 150 coupled to sensors to monitor and actuators to manipulate.

The rotary die cutter no can cut the sheets 140 into independent flows of sheets 140, which can be designated for independent stacking or receiving elements 130 (or for a single receiving element 130, which can have multiple elements or aspects). The rotary die cutter no can cut or perforate the sheets 140 along separation lines 142. After cutting or perforation the sheets 140 can be drawn apart into independent flows to stacking or receiving elements 130.

The trim removal section 120 can include a set of trim arm assemblies 122. Each trim arm assembly 122 can receive the sheets 140. Collectively, the trim arm assemblies 122 remove any unwanted trim (not shown) and separate the sheets 140 into their independent flows.

Each trim arm assembly 122 can be angled (sometimes referred to herein as "skewed") so that the independent flows of sheets 140 are delivered to the stacking or receiving elements 130. The control element 150 is coupled to the trim arm assemblies 122, and is disposed to skew the trim arm assemblies 122 so that collectively the trim arm assemblies 122 separate the sheets 140 into their independent flows.

Although this application primarily describes systems that include rotary die cutters and trim arm assemblies for separating flows of sheets, in the context of the invention, there is no particular requirement for any such limitation. For a first example, there is no requirement for a rotary die cutter in any of the systems or circuits described herein; this application describes the rotary die cutter for convenience, and only as an exemplary embodiment. The rotary die cutter could be replaced with any other earlier device in a process workflow. For a second example, there is no requirement that the flows of sheets are actually separated by the trim arm assemblies; they might be independent flows that are moving through the system in parallel.

The figure also shows other and further elements, as otherwise and further described herein.

Trim Arm Assembly

Figure 2:
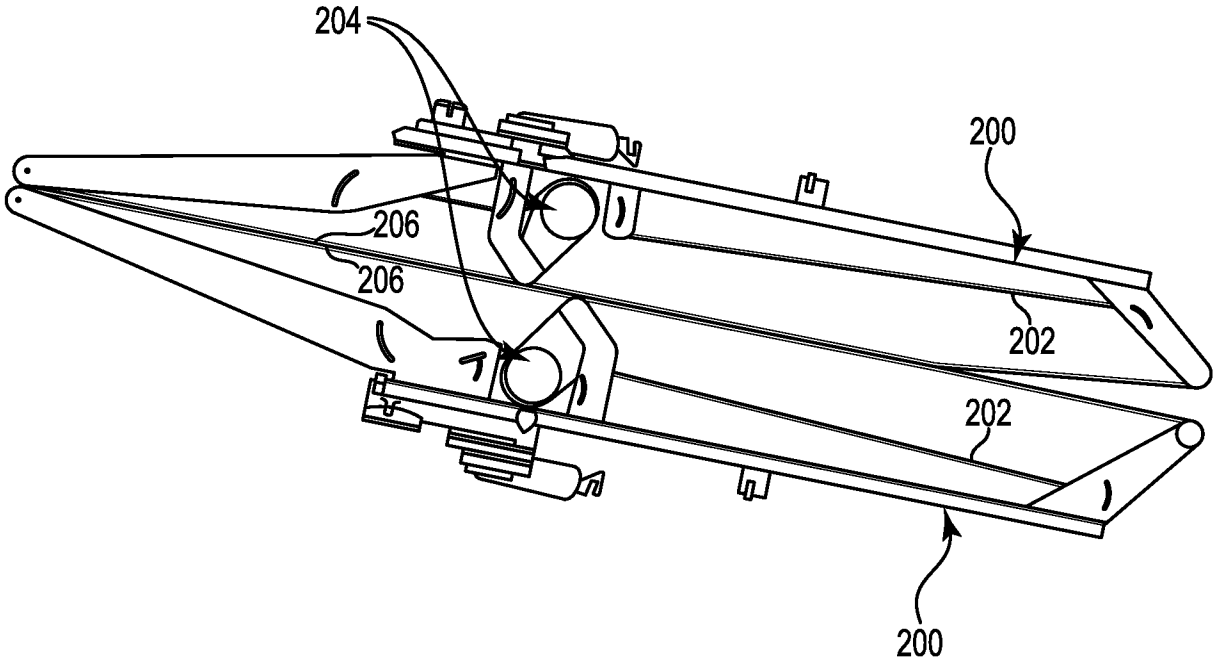
FIG. 2 shows a conceptual drawing of a trim arm assembly.

FIG. 2 shows a conceptual drawing of a trim arm assembly.

A trim arm assembly 122 includes an upper trim arm 200 and a lower trim arm 200 (where necessary or convenient, sometimes distinguished herein as 200U and 2000. Each trim arm 200 includes a first belt 202, driven by a belt drive pulley 204, and a second belt 206, also driven by the same belt drive pulley 204. Each trim arm 200 can also be outfitted with brushes or blowers (not shown) to remove unwanted trim.

Although this application primarily describes systems that include both a first belt and a second belt driven by the same belt drive pulley for each trim arm, in the context of the invention, there is no particular requirement for any such limitation. For a first example, a motion system other than belt drives could be used in addition to or instead of the belt drive pulley. For a second example, each trim arm in the trim arm assembly could include more than one belt drive pulley, or could include another technique operating in addition to or instead of a second belt drive pulley. Any suitable number of belts and pulleys can be used, from one or more, or gears or other structure can be used.

The first belt 202 and second belt 206 draw the sheets 140 into their flows. When skewed, the first belt 202 and second belt 206 can draw the sheets 140 at an angle responsive to the amount of skew. This can have the effect of allowing the sheets 140 to separate into independent flows and move in the direction of one or more stacking or receiving elements 130.

The figure also shows other and further elements, as otherwise and further described herein.

Trim Arm Adjustment Assembly

Figure 3:
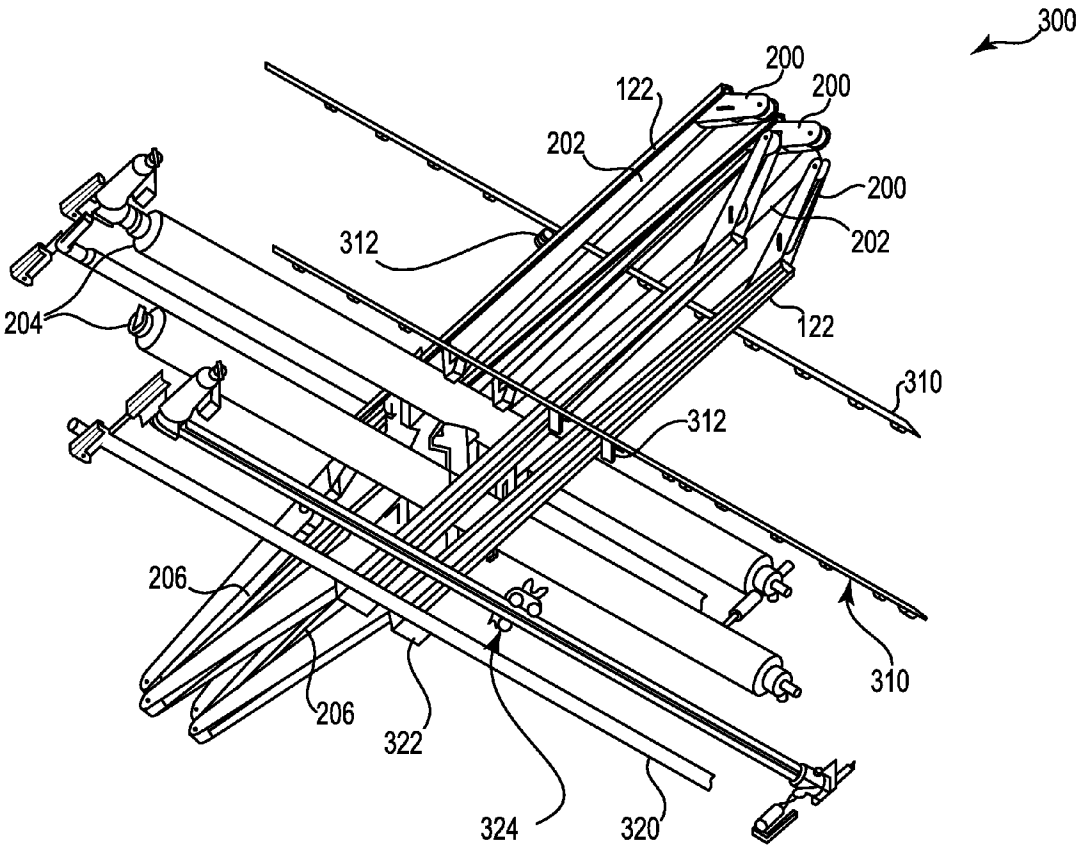
FIG. 3 shows a conceptual drawing of a trim arm adjustment assembly.

FIG. 3 shows a conceptual drawing of a trim arm adjustment assembly.

A trim arm adjustment assembly 500 includes a set of trim arm assemblies 122, each including an upper trim arm 200 and a lower trim arm 200. (In the figure, only two trim arms 200 are shown, to keep the figure relatively simple; however, in practice there could be about ten to twenty trim arms 200, as for example shown elsewhere herein, or some other desired number of trim arms 200.) The figure also shows upper and lower belt drive pulleys 204, and upper and lower first belts 202 and second belts 206.

The trim arm adjustment assembly 300 also includes a trim arm position sensor 310, which can be used when detecting the location of each trim arm 200. In one embodiment, the trim arm position sensor 310 can include a magnetostrictive linear position sensor; however, in the context of the invention, there is no particular requirement for any limitation to such a particular sensor or type of sensor. For example, other types of sensor would also be workable; these could include sensors whose operation uses techniques involving lasers, photodiodes, sonic elements, or otherwise. The trim arm position sensor 310 can couple to each trim arm 200 using a trim arm support wheel 312, as further described herein.

The trim arm adjustment assembly 300 also includes one anchor rail 320 for the top trim arm 200 and one anchor rail 320 for the bottom trim arm 200. The anchor rail 320 allows trim arm anchors 322 to slide along it in response to a positioning shuttle 324, as further described herein.

Although this application primarily describes a system in which the anchor rail is substantially perpendicular to the direction of flow of the sheets, in the context of the invention, there is no particular requirement for any such limitation. For example, the anchor rail could be positioned at an angle to the direction of flow, or the anchor rail could have a curved shape with respect to the direction of flow (e.g., the anchor rail could be bowed outward in the middle).

Similarly, although this application primarily describes a system in which the trim arm anchors slide along the anchor rail, in the context of the invention, there is no particular requirement for any such limitation. For a first example, the trim arm anchors could be moved along a belt or pulley, or could be rolled along the anchor rail. For a second example, the trim arm anchors could be selected from a set of possible "pop-out" anchors; while this may limit the granularity of positioning of the trim arms, it would allow the system to know with precision where each trim arm anchor is located.

Similarly, although this application primarily describes a system in which a positioning shuttle is used, or in which the positioning shuttle is moved along a transverse support, in the context of the invention, there is no particular requirement for any such limitation. For example, a positioning arm or other robotic device could be used to set the base location and angle of each trim arm.

The figure also shows other and further elements, as otherwise and further described herein.

Trim Arm Positioning Shuttle

Figure 4:
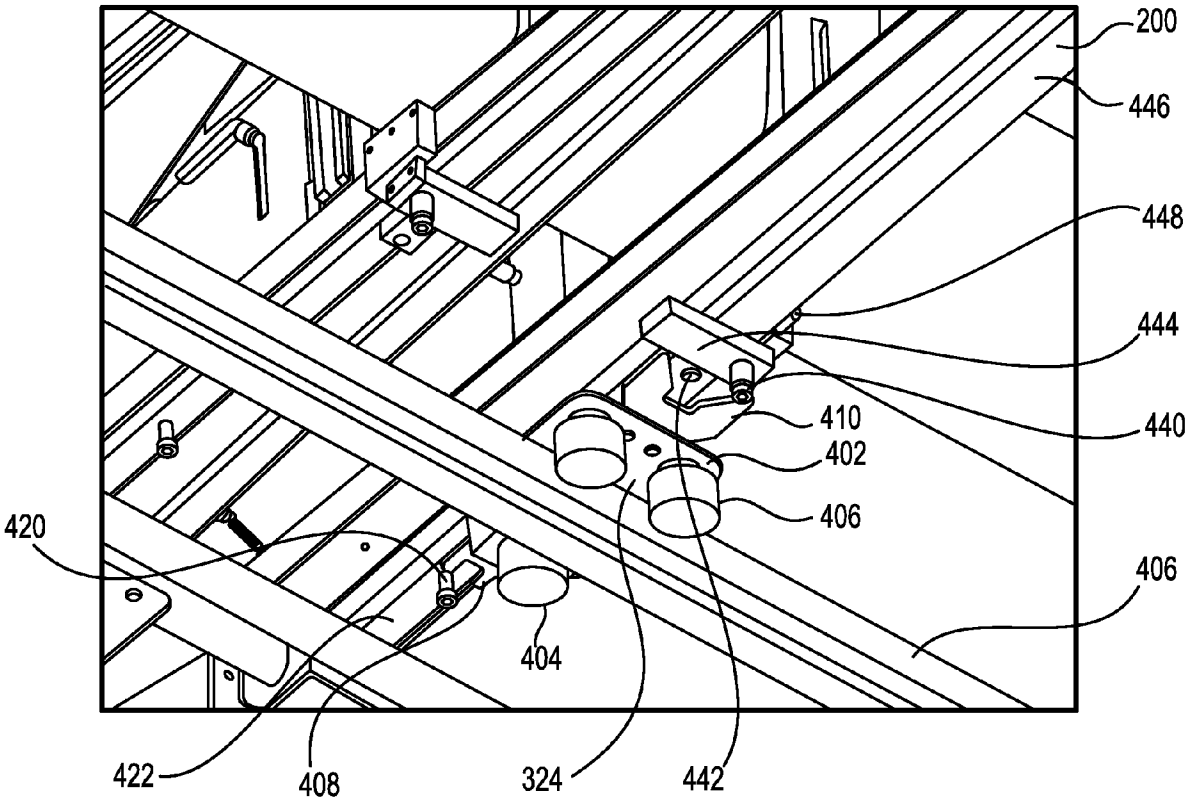
FIG. 4 shows a conceptual drawing of a positioning shuttle, and related mechanisms.

FIG. 4 shows a conceptual drawing of a positioning shuttle, and related mechanisms.

The positioning shuttle 324 includes elements shown in the figure, including at least a base piece 402, one or more rollers 404 coupled to a transverse positioning rail 406, an arm spacing adjustment tool 408, and an arm skewing adjustment tool 410. As shown in the figure, the rollers 404, the arm spacing adjustment tool 408, and the arm skewing adjustment tool 410 are coupled to the base piece 402. As also shown in the figure, the rollers 404 are operatively coupled to the transverse positioning rail 406. The transverse positioning rail 406 allows the rollers 404 to move the positioning shuttle 324 transverse to its associated trim arm 200.

The arm spacing adjustment tool 408 is disposed to couple and decouple from an arm spacing pin 420. The arm spacing pin 420 is coupled to an internal metal rod 422 associated with the trim arm 200. When the arm spacing adjustment tool 408 is coupled to the arm spacing pin 420, the internal metal rod 422 can be adjusted right or left along the transverse anchor rail 320 when the positioning shuttle 324 is moved right or left along the transverse positioning rail 406.

Although this application primarily describes a system in which the arm spacing adjustment tool is coupled to the trim arm and adjusted right or left along the transverse anchor rail, in the context of the invention, there is no particular requirement for any such limitation. For a first example, the positioning shuttle could use a gear, rotor, belt, or cable to move the trim arm along the transverse rail. Moreover, the positioning shuttle could use a gear, rotor, belt, or cable to move the trim arm into or out of a locked position on the transverse rail.

The arm skewing adjustment tool 410 is disposed to couple and decouple from an arm skewing pin 440. When the arm skewing adjustment tool 410 contacts the arm skewing pin 440, it pushes the arm skewing pin 440 away from an arm skewing anchor 442, with the effect that the trim arm 200 is free to skew. When the arm skewing adjustment tool 410 contacts the arm skewing pin 440, it also pushes the arm skewing pin 440 toward the center of the arm skewing adjustment tool 410, with the effect that the arm skewing pin 440 is disposed in a known position with respect to the positioning shuttle 324. The arm skewing pin 440 is coupled to a skewing element 444, which is coupled to an external metal tube 446 surrounding the internal metal rod 422. This has the effect that the external metal tube 446 can be moved by the skewing element 444, placing it at an angle from the internal metal rod 422.

Similarly, although this application primarily describes a system in which the arm skewing adjustment tool is coupled to the trim arm and adjusted right or left transverse to the anchor rail, in the context of the invention, there is no particular requirement for any such limitation. For a first example, the positioning shuttle could use a gear, rotor, belt, or cable to move the trim arm at an angle from its locked position on the transverse rail. For a second example, the positioning shuttle could use a gear, rotor, belt, or cable to move the trim arm into or out of a locked skew position.

When the trim arm 200 is free to skew, it can cause the trim arm 200 to skew toward the right or the left. Once the trim arm 200 has been skewed, the arm skewing adjustment tool 410 can release the arm skewing pin 440. Upon release, an arm skewing spring 448 pushes the arm skewing pin 440 back toward the arm skewing anchor 442, where it remains anchored until deliberately moved again.

The figure also shows other and further elements, as otherwise and further described herein.

Trim Arm Skew Lock

Figure 5:
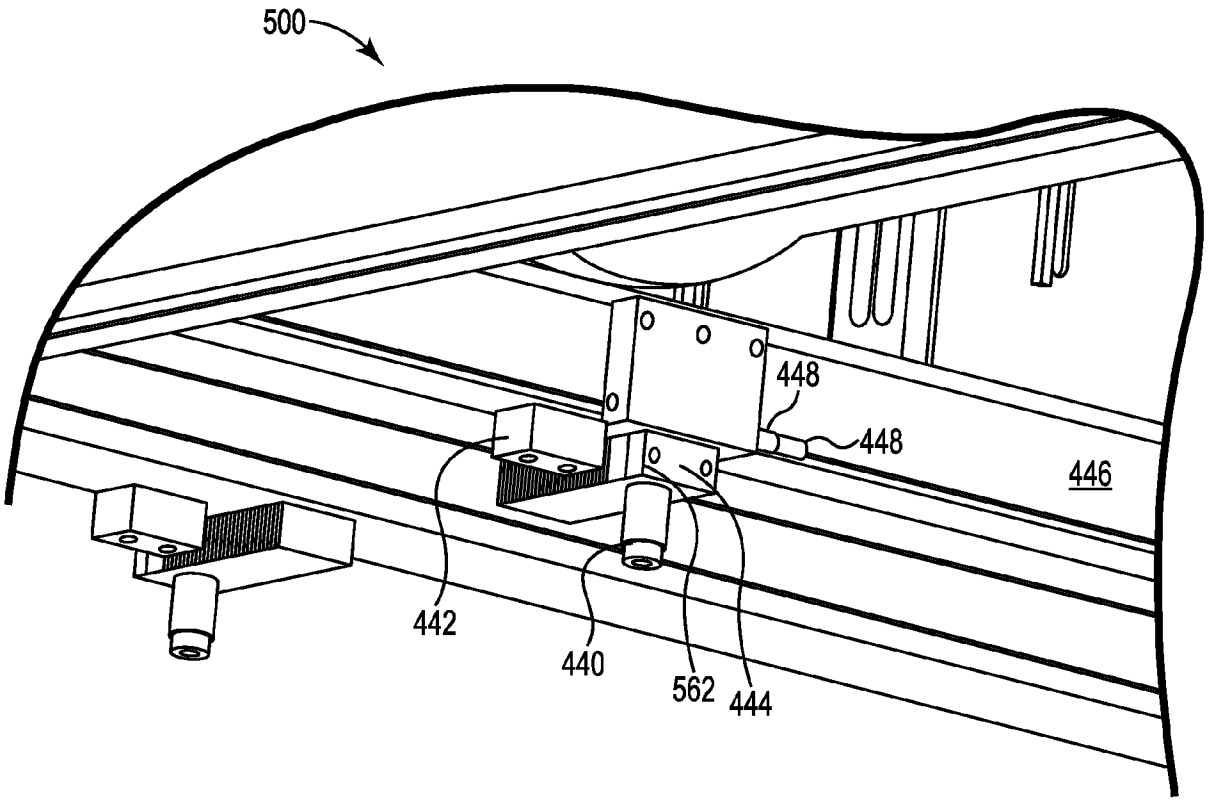
FIG. 5 shows a conceptual drawing of a trim arm skew lock.

FIG. 5 shows a conceptual drawing of a trim arm skew lock.

A trim arm skew lock 500 includes elements as shown in the figure, including at least the arm skewing pin 440, the arm skewing anchor 442, the skewing element 444, the skewing anchor 442, the arm skewing spring 448, and a set of skew-locking teeth 502.

As described above, the arm skewing adjustment tool 410 is disposed to couple and decouple from the arm skewing pin 440. The arm skewing anchor 442 is coupled to the internal metal rod 422, while the skewing element 444 is coupled to the external metal tube 446. When the arm skewing adjustment tool 410 pushes the arm skewing pin 440, the arm skewing anchor 442 is pushed away from the skewing element 444, and becomes able to skew right or left.

As shown in the figure, the arm skewing anchor 442 and the skewing element 444 are each vertically toothed (the vertical teeth of the skewing element 444 being shown as vertical teeth 502, while the matching vertical teech of the arm skewing anchor 442 are not shown in the figure), so that the arm skewing anchor 442 and the skewing element 444 cannot move horizontally right or left with respect to each other when engaged. As described above, when the arm skewing anchor 442 is actively pushed away from the skewing element 444, the two elements become disengaged, and become able to skew right and left.

When the arm skewing anchor 442 is no longer actively pushed away from the skewing element 444, the skewing lock spring 448 pushes the arm skewing anchor 442 back into contact with the skewing element 444. This returns the trim arm skew lock 500 to its state in which it cannot skew right or left.

Although this application primarily describes a system in which the arm skewing anchor and the skewing lock joint 502 are each vertically toothed for locking purposes, and are pushed apart or back together to unlock and re-lock the trim arm skew lock, in the context of the invention, there is no particular requirement for any such limitation. For example, the arm skewing anchor and the skewing lock joint 502 could be locked and unlocked with a screw twist, an inflatable bladder, or other techniques.

The figure also shows other and further elements, as otherwise and further described herein.

Trim Arm Positioning Assembly

Figure 6A:
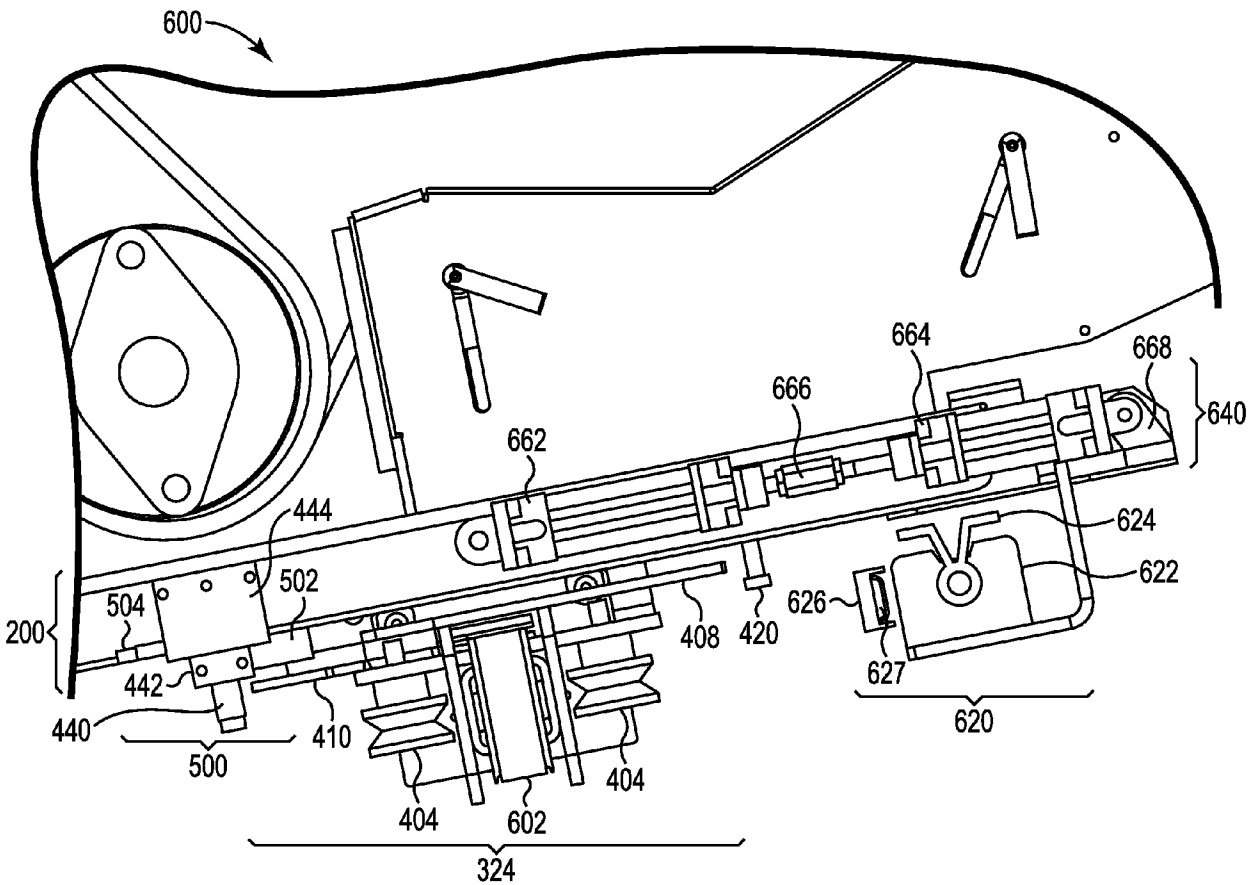
FIGS. 6A-B show conceptual drawings of a trim arm positioning assembly.
Figure 6B:
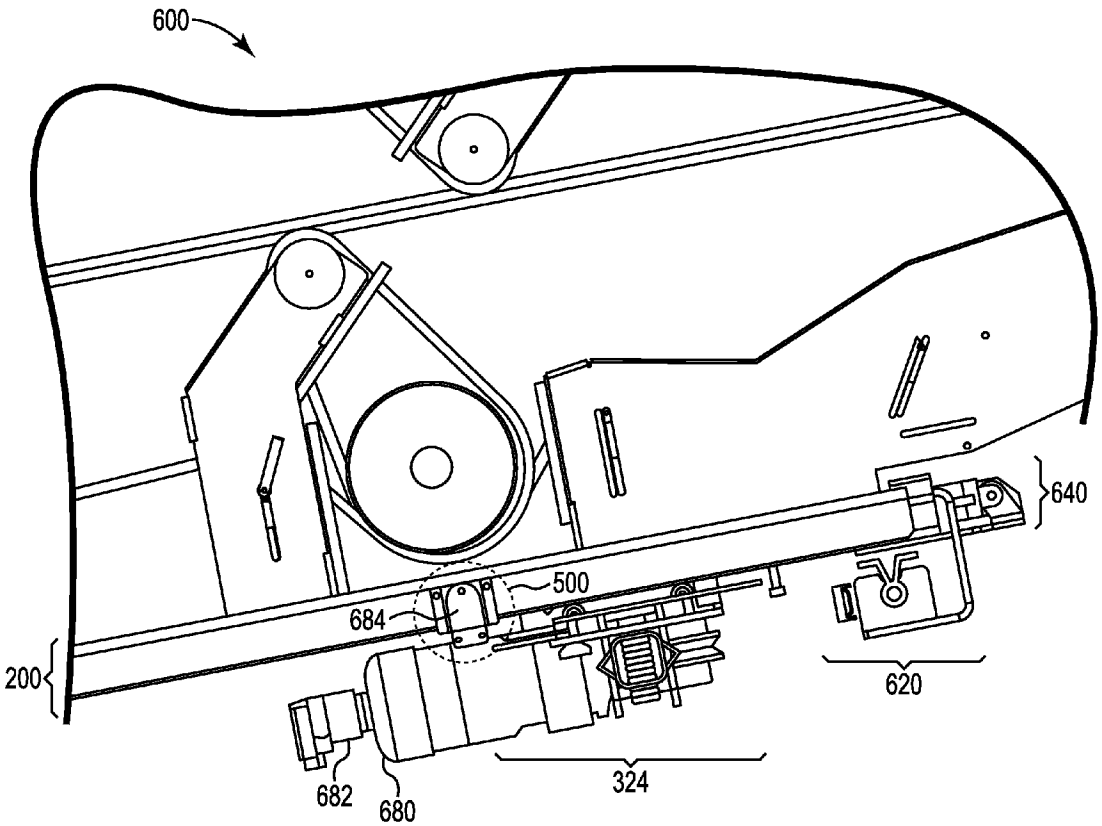

FIGS. 6A-B show conceptual drawings of a trim arm positioning assembly. FIG. 6A shows a $1^{st}$ conceptual drawing. FIG. 6B shows a $2^{nd}$ conceptual drawing.

$1^{st}$ Conceptual Drawing

FIG. 6A shows a $1^{st}$ conceptual drawing of a trim arm positioning assembly.

A trim arm positioning assembly 600 includes elements as shown in the figure, including at least one of the trim arms 200, the positioning shuttle 324, an arm spacing assembly 620, the trim arm skew lock 500, and a shuttle mover 640.

As noted above, the positioning shuttle 324 can include at least the base piece (not shown), the one or more rollers 404 disposed to move along the transverse positioning rail 406, the arm spacing adjustment tool 408, and the arm skewing adjustment tool 410. The positioning shuttle 324 can move along the transverse positioning rail 406 using the one or more rollers 404, coupled to a propulsion element 602, such as a motor or rotor. The shuttle mover 640 can also move the positioning shuttle 324 along the trim arm 200 (thus, generally perpendicular to the transverse positioning rail 406), as described herein.

Although this application primarily describes the positioning shuttle 324 as having one or more rollers 404 disposed to move along the transverse positioning rail 406, in the context of the invention, there is no particular requirement for any such limitation. For a first example, one or more sliders could operate in addition or instead of at least one of the rollers 404. For a second example, one or more magnetic or electromagnetic elements could operate in addition to, or instead of, other elements.

The figure also shows the arm spacing pin 420, which can be coupled, using the arm spacing adjustment tool 408, to the arm spacing assembly 620, as described herein. As noted above, when the arm spacing adjustment tool 408 pushes against the arm spacing pin 420, the latter moves an internal metal rod (not shown), which moves the trim arm 200 toward the arm spacing assembly 620.

In one embodiment, the arm spacing assembly 620 includes an arm spacing bearing 622, an arm spacing rail holder 624, and an arm spacing lock 626. The arm spacing bearing 622 can include a substantially solid block, suitable for holding the arm spacing rail holder 624 and for abutting against the arm spacing lock 626. The arm spacing rail holder 624 can include a wing-shaped element, suitable for hanging from the anchor rail 320 and suitable for moving when the positioning shuttle 324 moves right or left along the transverse positioning rail 406. The arm spacing lock 626 can include an air bladder 627, which when inflated, is thereby positioned to press against the arm spacing bearing 622 and, in response to friction from the position of the air bladder 627, prevents the latter from moving right or left along the anchor rail 320.

Although this application primarily describes the arm spacing assembly 620 as using mechanical elements to position and lock the trim arm 200 in place, in the context of the invention, there is no particular requirement for any such limitation. For a first example, one or more mechanical teeth or electromagnetic elements could operate in addition to, or instead of, the arm spacing bearing 622 and the arm spacing lock 626, to hold the trim arm 200 in place. For a second example, one or more rollers, or one or more electromagnetic elements could operate in addition to, or instead of, other elements to move the trim arm 200 right or left along the anchor rail 320 when the positioning shuttle 324 moves right or left along the transverse positioning rail 406.

The figure also shows the arm skewing pin 440, which can be moved, using the arm skewing adjustment tool 410, as part of the trim arm skew lock 500, as described herein. As noted above, when the arm skewing adjustment tool 410 pushes against the arm skewing pin 440, the latter adjusts the positioning of the trim arm skew lock 500.

As described above, the trim arm skew lock 500 includes the arm skewing pin 440, the arm skewing anchor 442, the skewing element 444, the skewing lock spring 504, and the external metal tube (not shown). As described herein, the arm skewing anchor 442 and the skewing element 444 operate, when pressed together in conjunction with the skewing lock joint 502, to prevent the trim arm 200 from changing its skew angle. As also described herein, the skewing lock spring 504 operates to press the arm skewing anchor 442 and the skewing element 444 against the skewing lock joint 502 when the positioning shuttle 324 and the arm skewing spring 440 are not operating to decouple them.

Although this application primarily describes the trim arm skew lock 500 as using mechanical elements to position and lock the trim arm 200 at its skew angle, in the context of the invention, there is no particular requirement for any such limitation. For a first example, one or more electromagnetic elements could operate in addition to, or instead of, arm skewing pin 440 and the skewing element 444 to set the trim arm 200 at its skew angle. For a second example, one or more electromagnetic elements could operate in addition to, or instead of, the arm skewing anchor 442, the skewing lock joint 502, and the skewing lock spring 504, to lock the trim arm 200 at its skew angle.

In one embodiment, the shuttle mover 640 includes a first movable cylinder 662, a second movable cylinder 664, a joinder pin 666, and a shuttle actuator 668. In one embodiment, the shuttle actuator 668 can select among three possible configurations: (A) The first movable cylinder 662 and the second movable cylinder 664 are both close to the joinder pin 666. (B) The first movable cylinder 662 is pushed away from the joinder pin 666. (C) The second movable cylinder 662 is pushed away from the joinder pin 666.

In one embodiment, the configuration "A" places the positioning shuttle 324 in a neutral position, in which it can move right or left along the transverse positioning rail 406.

In one embodiment, the configuration "B" places the positioning shuttle 324 in a skew adjustment position, in which it presses against the arm skewing pin 440. In this position, the positioning shuttle 324 can unlock the trim arm skew lock 500, adjust the skew of the trim arm 200, and re-lock the trim arm skew lock 500.

In one embodiment, the configuration "C" places the positioning shuttle 324 in a spacing adjustment position, in which it presses against the arm spacing pin 420. In this position, the positioning shuttle 324 can unlock the arm spacing assembly 620, adjust the spacing of the trim arm 200, and re-lock the arm spacing assembly 620.

Although this application primarily describes the shuttle mover 660 as using mechanical elements to move the positioning shuttle trim arm 200 at its skew angle, in the context of the invention, there is no particular requirement for any such limitation. For a first example, one or more electromagnetic elements could operate in addition to, or instead of, the first movable cylinder 662, the second movable cylinder 664, the joinder pin 666, and the shuttle actuator 668, to operate the positioning shuttle 324.

The figure also shows other and further elements, as otherwise and further described herein.

$2^{nd}$ Conceptual Drawing

FIG. 6B shows a $2^{nd}$ conceptual drawing of a trim arm positioning assembly.

A trim arm positioning assembly 600 includes elements as shown in the figure, including at least one of the trim arms 200, the positioning shuttle 324, an arm spacing assembly 620, the trim arm skew lock 500, the shuttle mover 640, and a shuttle control motor 680.

The shuttle control motor 680 includes at least a position encoder 682, a shuttle spacer motor (not shown), a shuttle pivot block 684, and a shuttle skew motor (not shown).

In one embodiment, the position encoder 682 informs the control element 150 of the location of the positioning shuttle 324. For a first example, the position encoder 682 can include a wheel that rotates when the positioning shuttle 324 moves, enabling the control element 150 to determine the location of the positioning shuttle 324. For a second example, the position encoder 682 can include some other technique for enabling the control element 150 to determine the location of the positioning shuttle 324, such as a gyroscope or an electromagnetic element.

In one embodiment, the shuttle spacer motor moves the positioning shuttle 324 along the transverse positioning rail 406, as described above. Although this application primarily describes a system in which the shuttle spacer motor moves the positioning shuttle 324 using mechanical techniques, in the context of the invention, there is no particular requirement for any such limitation. For example, the shuttle spacer motor could operate using a maglev technique for moving the positioning shuttle 324.

In one embodiment, the shuttle pivot block 684 allows the positioning shuttle 324 to adjust its angle while using the arm skewing adjustment tool 410, as described herein. For example, when the positioning shuttle 324 seizes the skewing adjust pin 440, it can pivot right or left using the shuttle pivot block 684, with the effect of adjusting the skew of the trim arm 200.

In one embodiment, the shuttle skew motor operates to rotate the positioning shuttle 324 about the shuttle pivot block 684, with the effect that the positioning shuttle 324 adjusts its angle while using the arm skewing adjustment tool 410, as described herein. For example, the positioning shuttle 324 can pivot right or left using the shuttle pivot block 684, with the effect of moving the skewing adjust pin 440, with the effect of adjusting the skew of the trim arm 200.

Although this application primarily describes a system in which the positioning shuttle 324 can adjust its angle using mechanical techniques, in the context of the invention, there is no particular requirement for any such limitation. For example, the shuttle pivot block 684 and the shuttle skew motor could use electromagnetic techniques, in addition to, or instead of, mechanical techniques.

The figure also shows other and further elements, as otherwise and further described herein.

Trim Arm Adjustment

FIGS. 7A-D show conceptual drawings of operating a mechanism for trim arm adjustment.

Figure 7A:
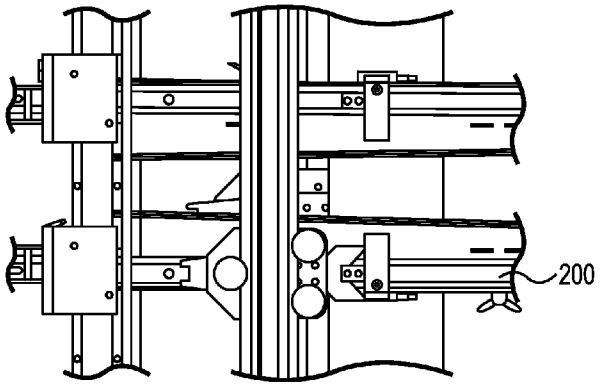
FIGS. 7A-D show conceptual drawings of operating a mechanism for trim arm adjustment.

In FIG. 7A, the positioning shuttle 324 is moved to align with a selected trim arm 200. The arm spacing lock 626 is unlocked. For example, when the arm spacing lock 626 includes an air bladder 627, the air bladder 627 can be deflated to reduce locking friction.

Figure 7B:
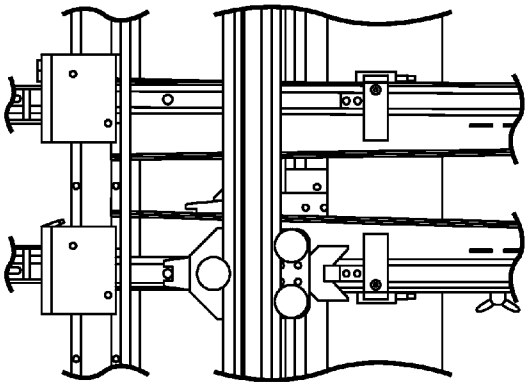

In FIG. 7B, the positioning shuttle 324 is moved to seize the arm spacing pin 420, so as to set the position of that trim arm 200. The positioning shuttle 324 is then moved to a selected location for the trim arm 200, thus setting the position of that trim arm 200.

Figure 7C:
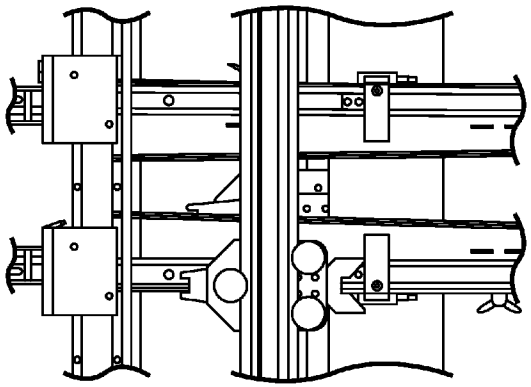

In FIG. 7C, the positioning shuttle 324 is moved to align with the arm skewing pin 440. As the control element 150 need not maintain the location of the arm skewing pin 440, the positioning shuttle 324 includes a grasping mechanism that seizes the arm skewing pin 440 regardless of the latter's offset.

Figure 7D:
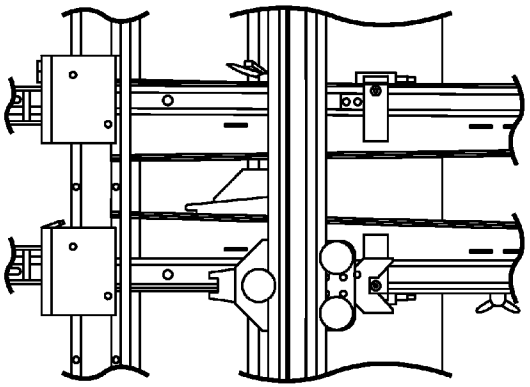

In FIG. 7D, the positioning shuttle 324 is moved to seize the arm skewing pin 440. The arm skewing pin 440 is seized by the grasping mechanism regardless of its offset. The positioning shuttle 324 rotates or translates to move the arm skewing pin 440, with the effect of adjusting the skew of the trim arm 200.

Although this application primarily describes a system in which the positioning shuttle 324 first adjusts the location, and second adjusts the skew, of the trim arm 200, in the context of the invention, there is no particular requirement for any such limitation. For a first example, the positioning shuttle 324 can first adjust the skew, and second adjust the location. For a second example, the positioning shuttle 324 can adjust the location and the skew concurrently.

The figure also shows other and further elements, as otherwise and further described herein.

Method of Use

Figure 8:
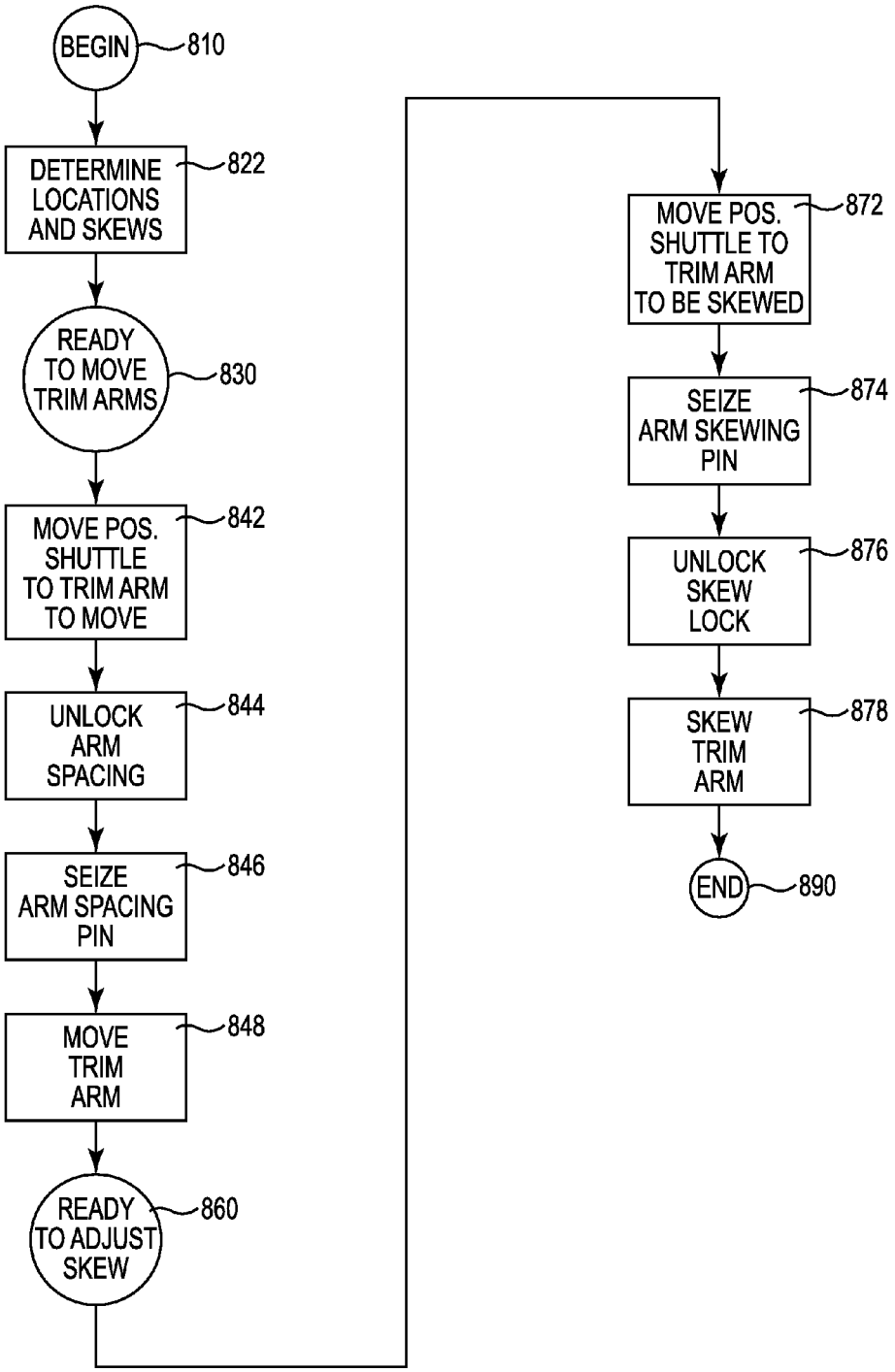
FIG. 8 shows a conceptual drawing of a method of using an automated trim arm adjustment assembly.

FIG. 8 shows a conceptual drawing of a method of using an automated trim arm adjustment assembly.

A method 800 of using an example system includes flow labels and method steps as described herein. In one embodiment, the method steps are performed in an order as described herein. However, in the context of the invention, there is no particular requirement for any such limitation. For example, the method steps can be performed in another order, in a parallel or pipelined manner, concurrently, or otherwise.

References to "the method" performing selected steps are intended to refer to one or more elements of the system 100 performing those steps, either collectively, in conjunction, separately, or otherwise.

A flow label 810 indicates that the method 800 is ready to begin.

At a step 822, the method 800 determines one or more locations and skew values for trim arms 200. For a first example, the control element 150 can receive input from one or more operators indicating locations and skew values. For a second example, the control element 150 can receive input from one or more operators indicating a standard setting, from which the control element 150 can determine locations and skew values. For a third example, the control element 150 can determine factors such as the flow rate and thickness of the sheets, and from those determine a substantially optimum set of locations and skew values.

A flow label 830 indicates that the method 800 is ready to move trim arms 200.

At a step 842, the method 800 selects one or more trim arms 200 that need to be moved, and moves a corresponding number of positioning shuttles 324 to align with the arm spacing pins 420 of those trim arms 200. In one embodiment, there is only one positioning shuttle 324, so the method 800 selects only one such trim arm 200 and only one such arm spacing pin 420. For example, the method 800 can select the next trim arm 200 to be moved that is most far right in the system 100, and move the one positioning shuttle 324 to align with that trim arm 200, such as shown in panel 7A above. If there are no trim arms 200 that need to be moved, such as if they have all already been moved, the method 800 proceeds with the flow point 860.

At a step 844, the method 800 unlocks the arm spacing lock 626 associated with the selected trim arm 200. For when the arm spacing lock 626 includes an air bladder 627, the air bladder 627 can be deflated to reduce locking friction.

At a step 846, the method 800 moves the positioning shuttle 324 to seize the arm spacing pin 420 associated with the selected trim arm 200, such as shown in panel 7B above.

At a step 848, the method 800 moves the positioning shuttle 324, with the effect of also moving the selected trim arm 200. The method 800 proceeds with the flow label 830, at which it is ready to move the next trim arm 200 (if there are any more trim arms 200 to be moved).

A flow label 860 indicates that the method 800 is ready to adjust the skew of trim arms 200.

At a step 872, the method 800 selects one or more trim arms 200 that need their skew adjusted, and moves a corresponding number of positioning shuttles 324 to align with the arm skewing pins 440 of those trim arms 200. In one embodiment, there is only one positioning shuttle 324, so the method 800 selects only one such trim arm 200. For example, the method 800 can select the next trim arm 200 to have its skew adjusted that is most far right in the system 100, and move the one positioning shuttle 324 to align with that trim arm 200, such as shown in panel 7C above. If there are no trim arms 200 that need to have their skew adjusted, such as if they have all already had their skew adjusted, the method 800 proceeds with the flow point 890.

At a step 874, the method 800 seizes the arm skewing pin 440 associated with the selected trim arm 200.

At a step 876, the method 800 unlocks the trim arm skew lock 500 associated with the selected trim arm 200.

At a step 878, the method 800 rotates or translates the positioning shuttle 324 to move the arm skewing pin 440, with the effect of adjusting the skew of the trim arm 200. The method 800 proceeds with the flow label 850, at which it is ready to adjust the skew of the next trim arm 200 (if there are any more trim arms 200 that need their skew adjusted).

A flow label 890 indicates the end of the method 800. The control element 150 conducts other business until such time as it is triggered to re-perform the method 800.

Trim Arm End View

Figure 9:
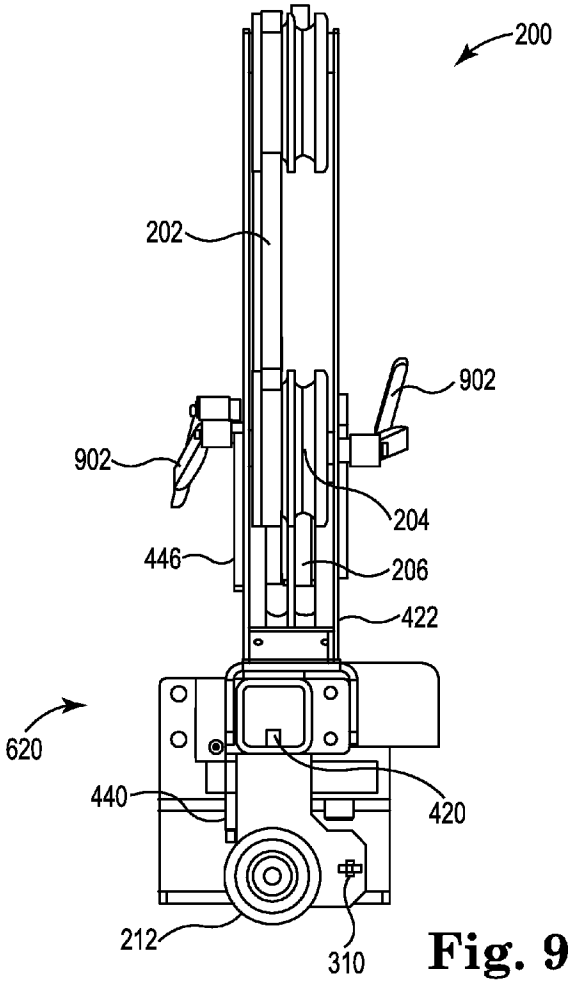
FIG. 9 shows a conceptual drawing of an end view of a trim arm.

FIG. 9 shows a conceptual drawing of an end view of a trim arm.

As can be seen from the figure, this particular trim arm 200 is a lower trim arm 200, as described herein. The trim arm 200 shows the first belt 202, driven by a belt drive pulley 204, as described herein, and the second belt 206, also driven by the same belt drive pulley 204, as described herein. The figure shows tightening elements 902, with the effect that a user or operator can adjust a tension on the first belt 202 or the second belt 206.

As can be seen from the figure, and as described herein, the trim arm 200 also includes the internal metal rod 422 and the external metal tube 446. In one embodiment, there is sufficient room between the internal metal rod 422 and the external metal tube 446 that the angle of the internal metal rod 422 with respect to the external metal tube 446 can be adjusted, with the effect of skewing the trim arm 200.

As can be seen from the figure, and as described herein, the trim arm 200 also includes the trim arm position sensor 310. This has the effect of being able to detect the location of each trim arm 200. As can be seen from the figure, and as described herein, the trim arm 200 also includes the trim arm support wheel 312, with the effect that the trim arm 200 can be supported while being moved transverse to the direction of the sheet flow.

As can be seen from the figure, and as described herein, the trim arm 200 also includes (as seen from an end-on point of view) the arm spacing pin 420. A portion of the arm spacing assembly 620 can be seen from the end-on point of view. As can be seen from the figure, and as described herein, the trim arm 200 also includes (as seen from an end-on point of view) the arm skewing pin 440. A portion of the skew adjust effector 410 can be seen from the end-on point of view.

The figure also shows other and further elements, as otherwise and further described herein.

Trim Arm Isometric View

Figure 10:
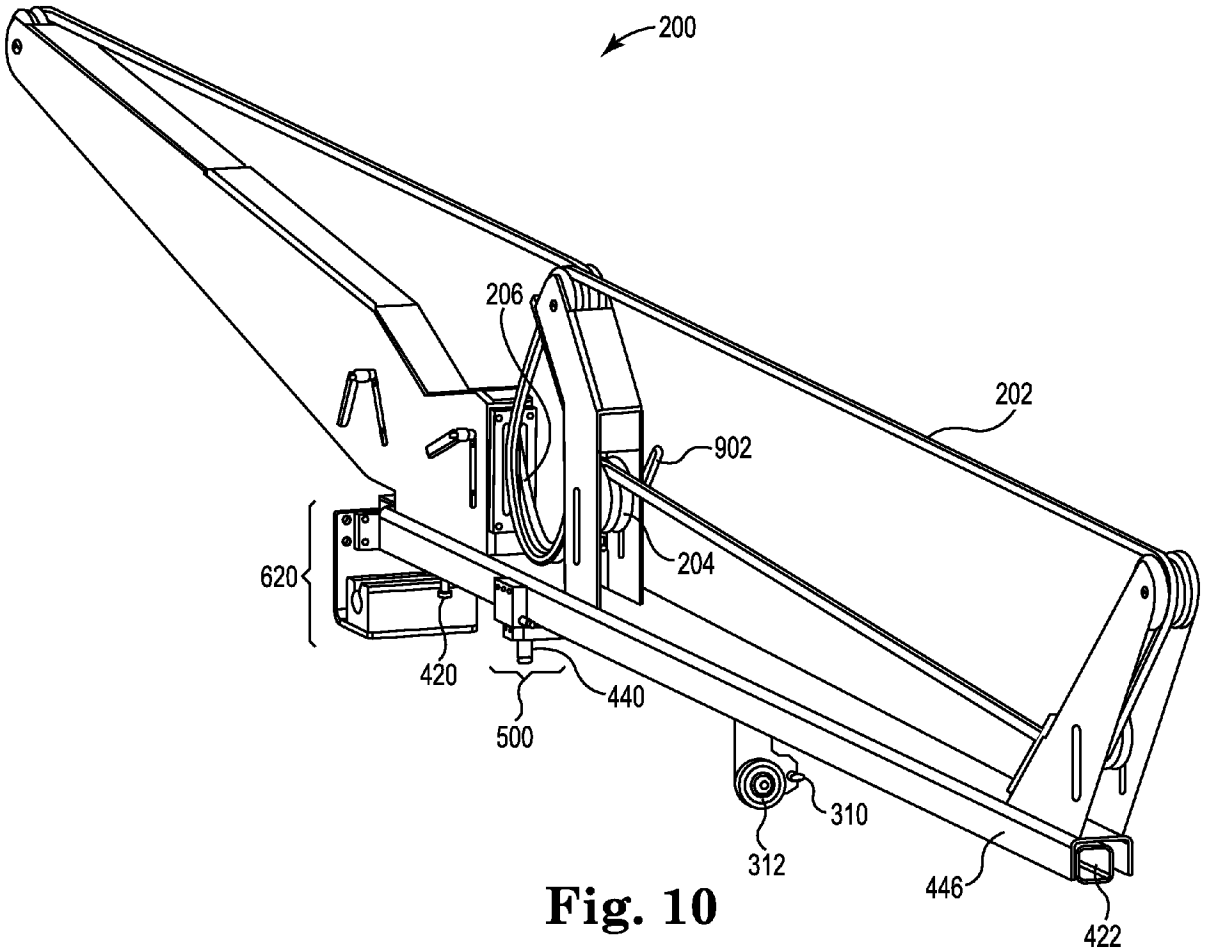
FIG. 10 shows a conceptual drawing of an isometric view of a trim arm.

FIG. 10 shows a conceptual drawing of an isometric view of a trim arm.

As can be seen from the figure, this particular trim arm 200 is a lower trim arm 200, as described herein. The trim arm 200 shows the first belt 202, driven by a belt drive pulley 204, as described herein, and the second belt 206, also driven by the same belt drive pulley 204, as described herein. The figure shows tightening elements 902, as described herein, with the effect that a user or operator can adjust a tension on the first belt 202 or the second belt 206.

As can be seen from the figure, and as described herein, the trim arm 200 also includes the internal metal rod 422 and the external metal tube 446. In one embodiment, there is sufficient room between the internal metal rod 422 and the external metal tube 446 that the angle of the internal metal rod 422 with respect to the external metal tube 446 can be adjusted, with the effect of skewing the trim arm 200.

As can be seen from the figure, and as described herein, the trim arm 200 also includes the trim arm position sensor 310. This has the effect of being able to detect the location of each trim arm 200. As can be seen from the figure, and as described herein, the trim arm 200 also includes the trim arm support wheel 312, with the effect that the trim arm 200 can be supported while being moved transverse to the direction of the sheet flow.

As can be seen from the figure, and as described herein, the trim arm 200 also includes (as seen from an oblique point of view) the arm spacing pin 420. A portion of the arm spacing assembly 620 can be seen from the end-on point of view. As can be seen from the figure, and as described herein, the trim arm 200 also includes (as seen from an oblique point of view) the arm skewing pin 440. A portion of the trim arm skew lock 500 can be seen from the oblique point of view.

The figure also shows other and further elements, as otherwise and further described herein.

Trim Removal Section Isometric View

Figure 11:
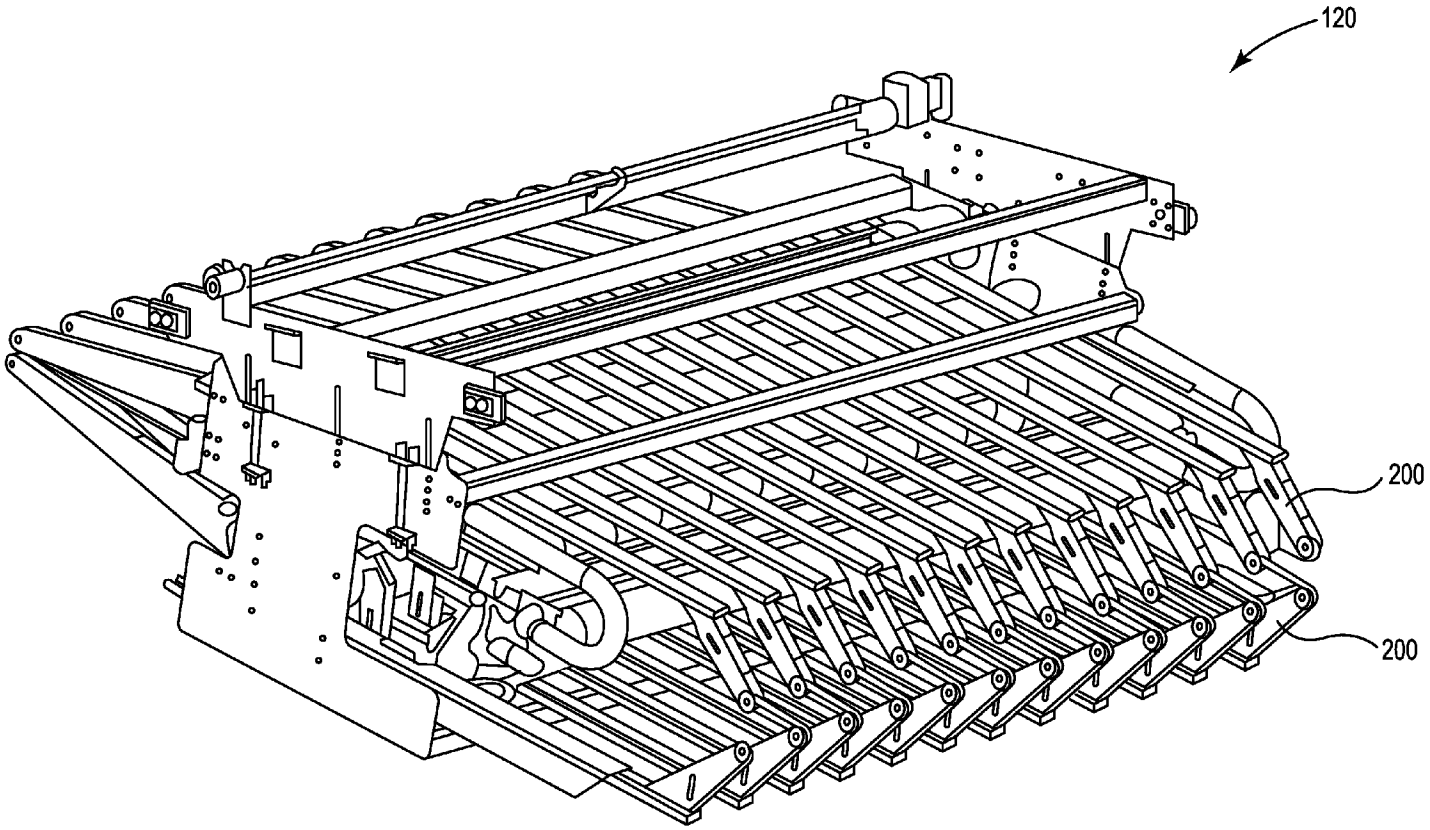
FIG. 11 shows a conceptual drawing of an isometric view of a trim arm assembly.

FIG. 11 shows a conceptual drawing of an isometric view of a trim removal section.

As can be seen from the figure, and as described herein, the trim removal section 120 includes about a dozen trim arm assemblies. Each trim arm assembly includes an upper trim arm 200 and a lower trim arm 200. This has the effect that when sheets move through the trim arm assembly, the trim removal section 120 affects them, such as by removing trim.

As can be seen from the figure, and as described herein, the trim removal section 120 includes approximately a dozen trim arm assemblies, each disposed as described herein with respect to an individual trim arm assembly. Each trim arm assembly includes an upper trim arm 200 and a lower trim arm 200, each disposed as described herein with respect to an individual trim arm.

The figure also shows other and further elements, as otherwise and further described herein.

Trim Removal Section Top View

Figure 12:
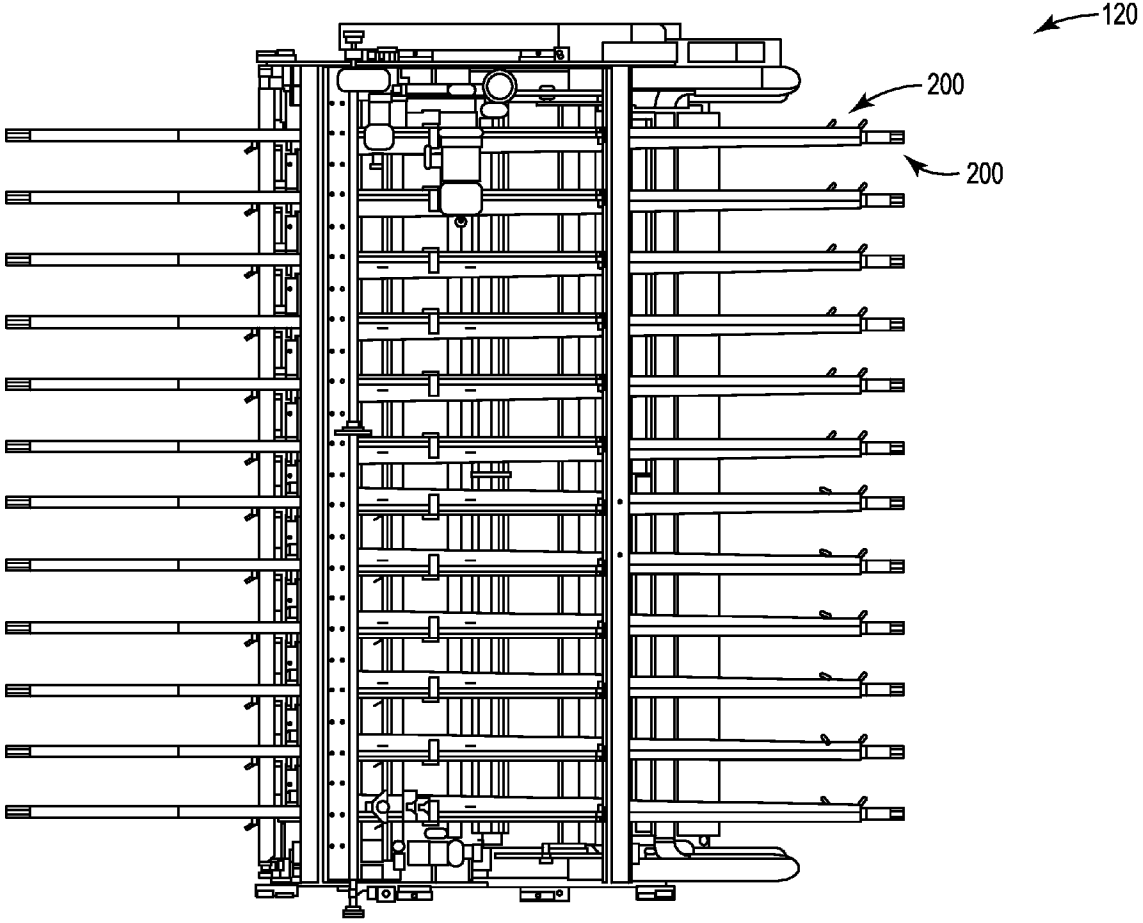
FIG. 12 shows a conceptual drawing of a top view of a trim arm assembly.

FIG. 12 shows a conceptual drawing of a top view of a trim removal section.

Similar to the FIG. 11, the FIG. 12 shows a trim removal section 120 that includes about a dozen trim arm assemblies. Each trim arm assembly includes an upper trim arm 200 and a lower trim arm 200. This has the effect that when sheets move through the trim arm assembly, the trim removal section 120 affects them, such as by removing trim.

As can be seen from the figure, and as described herein, the trim removal section 120 includes approximately a dozen trim arm assemblies, each disposed as described herein with respect to an individual trim arm assembly. Each trim arm assembly includes an upper trim arm 200 and a lower trim arm 200, each disposed as described herein with respect to an individual trim arm.

In particular, as can be seen from the figure, and as described herein, each trim arm assembly can be moved transverse to the movement direction of the sheets. Moreover, each trim arm assembly can be skewed by as much as approximately ten degrees to the right or left. This has the effect that the trim removal section 120 can separate cut sheets into separate flows, such as to be directed to distinct stackers.

The figure also shows other and further elements, as otherwise and further described herein.

Close Up of Trim Arm Positioning Element

Figure 13:
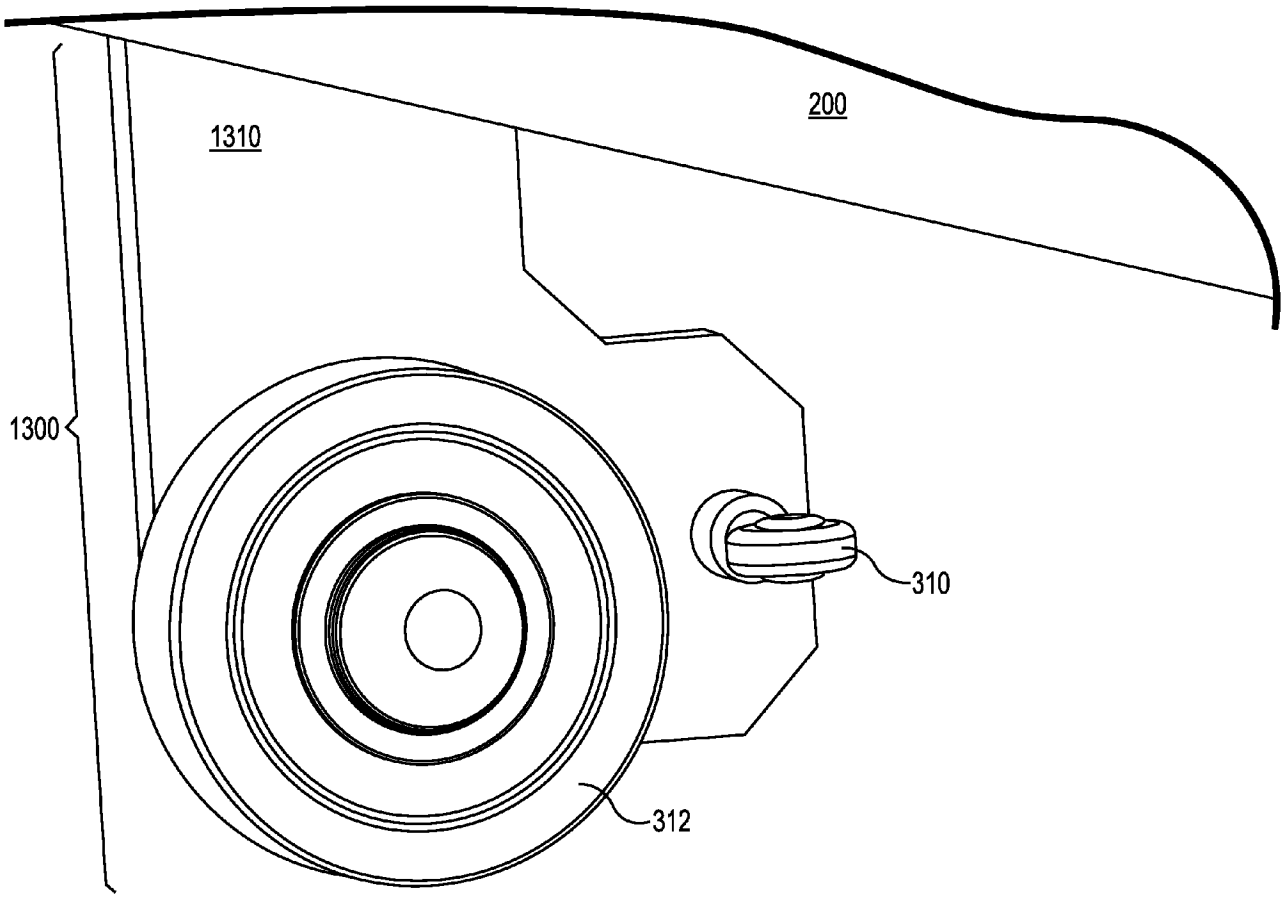
FIG. 13 shows a conceptual drawing of a close-up view of a trim arm positioning element.

FIG. 13 shows a conceptual drawing of a close-up view of a trim arm positioning element.

In one embodiment, the trim arm positioning element 1300 includes elements shown in the figure, including at least a trim arm positioning anchor 1310, capable of supporting and holding other elements, as described herein.

In one embodiment, the trim arm positioning element 1300 supports and holds the trim arm support wheel 312. In such embodiments, the trim arm support wheel 312 supports the trim arm 200 on a rail, or other structure, on which the trim arm 200 can ride while its position is being adjusted. In one embodiment, the trim arm support wheel 312 can be disposed with an axis substantially perpendicular to the trim arm 200. In the example shown in the figure, this axis substantially perpendicular to the trim arm 200 is also disposed so that it (the axis) passes through and perpendicular to a plane of the trim arm positioning anchor 1310.

In one embodiment, the trim arm positioning element 1300 also supports and holds the trim arm position sensor 310, which (as described herein) is used when detecting the location of each trim arm 200. For example, as described herein, the trim arm position sensor 310 can include a magnetostrictive linear position sensor, or another type of sensor, such as a sensor whose operation uses techniques involving lasers, photodiodes, sonic elements, or otherwise.

The figure also shows other and further elements, as otherwise and further described herein.

Close Up of Trim Arm Skewing Lock

Figure 14:
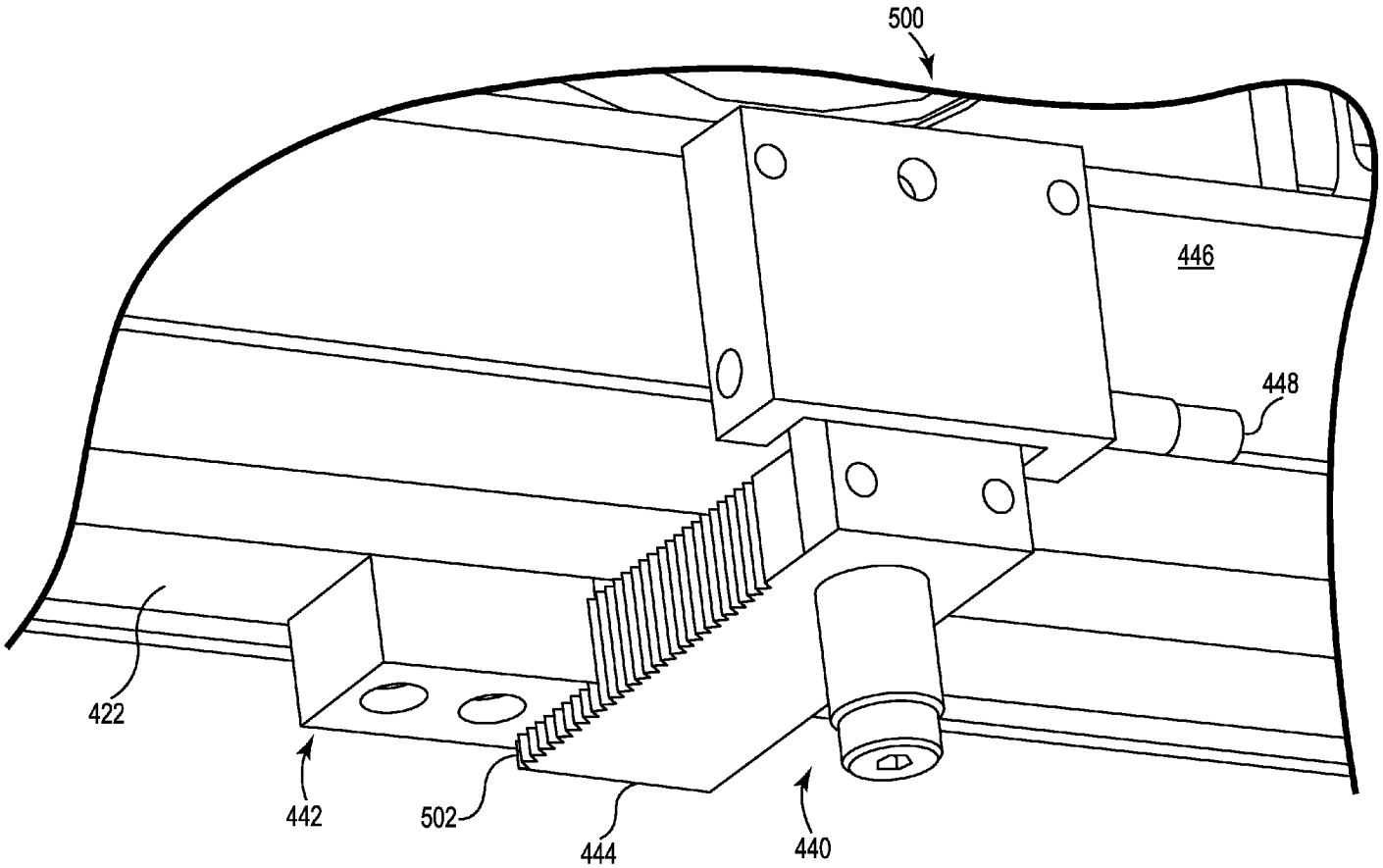
FIG. 14 shows a conceptual drawing of a close-up view of a trim arm skew lock.

FIG. 14 shows a conceptual drawing of a close-up view of a trim arm skew lock.

In one embodiment, the trim arm skew lock 500 includes elements as shown in the figure, including at least the arm skewing pin 440, the arm skewing anchor 442, the skewing element 444 having vertical teeth 502 (matched by vertical teeth, not shown, on the arm skewing anchor 442), with the skewing element 444 being coupled to an external metal tube 446, and the arm skewing anchor 442 being couped to the inner metal rod 422.

In one embodiment, the external metal tube 446 is slidably coupled to an internal metal rod 422, so that the external metal tube 446 can slide along the internal metal rod 422, with the effect that the trim arm 200 can be skewed to the right or left by a substantial angle, such as an angle of at least about 5 degrees to 10 degrees. In alternative embodiments, the external metal tube 446 can be coupled to the internal metal rod 422 in another way, or wholly another structure can be used, with the effect that the trim arm 20 can be skewed to the right or left by a substantial angle, such as an angle of at least about 5 degrees to 10 degrees, or alternatively a substantially larger angle.

In one embodiment, the trim arm skew lock 500 is substantially held in place by the skewing lock spring 448 on one side, and by the arm skewing anchor 442 on another side. Collectively, the skewing lock spring 448 and the arm skewing anchor 442 exert pressure on the skewing element 444, with the effect that the vertical teeth 502 of the skewing element 444 being matched to similar vertical teeth (not shown) of the arm skewing anchor 442, with the effect that the arm skewing anchor 442 and the skewing element 444 cannot skew with respect to each other. In alternative embodiments, other or further locking elements could be used, such as friction surfaces, hole-and-peg matching elements, wave-shaped teeth, or otherwise, with the effect of preventing the arm skewing anchor 442 and the skewing element 444 skewing with respect to each other.

In one embodiment, the arm adjustment shuttle 324 does not know where (specifically, how far laterally right or left) the skew adjust pin 440 is placed with respect to the center of the internal metal rod 422 or the external metal tube 446. This has the effect that the arm adjustment shuttle 324 does not know how skewed the trim arm 200 is before it adjusts the skew of that trim arm 200 to another value Accordingly, in one embodiment, the arm adjustment shuttle 324 includes a scoop-shaped (or V-shaped) arm skewing adjustment tool 410 (shown in FIG. 4). This has the effect that, when the arm adjustment shuttle 324 moves toward the skew adjust pin 440, the latter is forced to a center position with respect to the adjustment shuttle 324 and with respect to the arm skewing adjustment tool 410, with the effect that the adjustment shuttle 324 then knows where the skew pin 440 is placed (specifically, how far laterally right or left, and also longitudinally along the external metal tube 446).

In one embodiment, as described herein, the arm skewing adjustment tool 410 catches the skew adjust pin 440 and pushes both the skew adjust pin 440 and the skewing element 444 away from the arm skewing anchor 442. This has the effect that the vertical teeth 502 on the skewing element 444 are disengaged from corresponding vertical teeth (not shown) on the arm skewing anchor 442. In alternative embodiments, other techniques for preventing skewing of the trim arm 200 when not being actively adjusted are themselves disengaged.

In one embodiment, as described herein, having disengaged the skew adjust pin 440 and allowed the trim arm 220 to move laterally, the arm skewing adjustment tool 410 adjusts the lateral position of the skew adjust pin 440 to a known position. This has the effect of adjusting the amount of skew of the trim arm 200. Once the amount of skew of the trim arm 200 is set to a value selected by an operator or user (or by a control element or computer program invoked by an operator or user), the arm skewing adjustment tool 410 is disengaged from the skew adjust pin 440. This has the effect of allowing the skewing lock spring 448 to push the vertical teeth 502 of the skewing element 444 back into contact (or other engagement) with the corresponding vertical teeth (not shown) of the arm skewing anchor 442, and locking the trim arm 200 into the selected amount of skew.

The figure also shows other and further elements, as otherwise and further described herein.

Close Up of Trim Arm Spacing Lock

Figure 15:
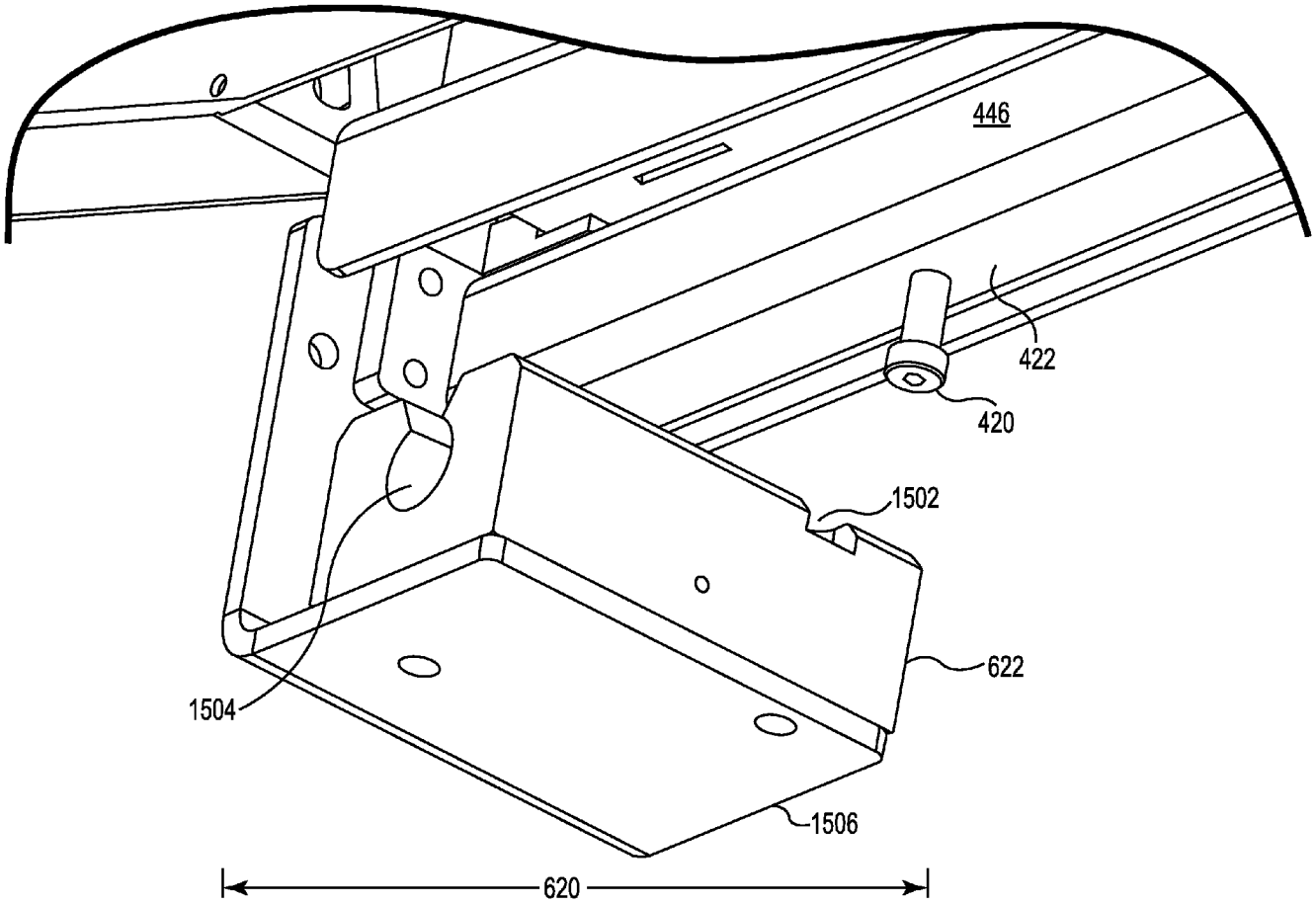
FIG. 15 shows a conceptual drawing of a close-up view of a trim arm spacing lock.

FIG. 15 shows a conceptual drawing of a close-up view of a trim arm spacing lock.

The arm spacing pin 420 can be coupled to the internal metal rod 422, with the effect that moving the arm spacing pin 420 laterally moves the trim arm 200 laterally, and disposes the trim arm 200 in a lateral position selected by an operator or user (or, as described herein, by a control element or computer program invoked by an operator or user).

When the arm spacing pin 420 is moved longitudinally (along the trim arm 200), it can enter the arm spacing assembly 620 using a spacing pin notch 1502. The arm spacing pin 420, having entered the notch 1502, can move the arm spacing assembly 620 laterally, such as by using lateral movement of the arm adjustment shuttle 324.

When moving laterally, the arm spacing assembly 620 can be moved along a rail (not shown), such as might be held by the arm spacing rail holder 624 (shown in FIG. 6A), which can fit in a rail holder notch 1504. Moreover, the arm spacing assembly 620 can be supported by an assembly support piece 1506, which can couple the arm spacing assembly 620 to the trim arm 200.

When the arm spacing pin 420 is moved laterally, the spacing pin notch 1502 can be used to hold the arm spacing pin 420 within the arm spacing assembly 620, with the effect that the arm spacing assembly 620 can be moved along the arm spacing rail holder 624 (which can be disposed in the rail holder notch 1504). When the arm spacing pin 420 is moved laterally, the assembly support piece 1506 can also move laterally, with the effect of moving the trim arm 200 laterally.

The figure also shows other and further elements, as otherwise and further described herein.

Bottom of Trim Arm (Side View)

Figure 16:
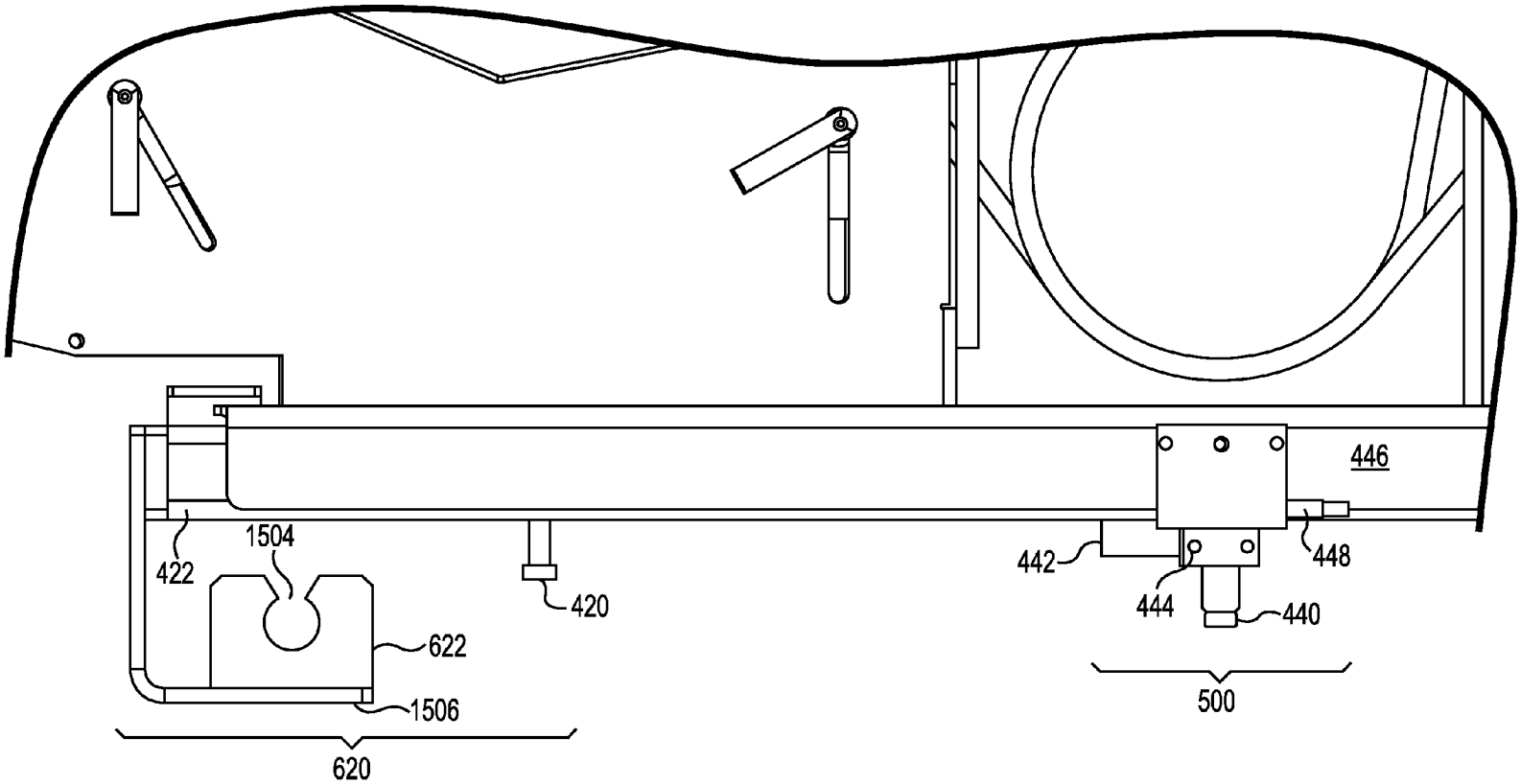
FIG. 16 shows a conceptual drawing of a side view of a bottom of a trim arm.

FIG. 16 shows a conceptual drawing of a side view of a bottom of a trim arm.

The bottom of the trim arm 200 can include the internal metal rod 422, the external metal tube 446, the trim arm skew lock 500 (as also described and shown herein, such as with respect to FIG. 14), and the arm spacing assembly 620 (as also described and shown herein, such as with respect to FIG. 15).

The trim arm skew lock 500 can include the skew adjust pin 440, the arm skewing anchor 442, the skewing element 444, and the skewing lock spring 448, as also described and shown herein, such as with respect to FIG. 14.

The arm spacing assembly 620 can include the arm spacing pin 420, the arm spacing bearing 622, the rail holder notch 1504, and the assembly support piece 1506, as also described and shown herein, such as with respect to FIG. 15.

The figure also shows other and further elements, as otherwise and further described herein.

Bottom of Trim Arm (Isometric View)

Figure 17:
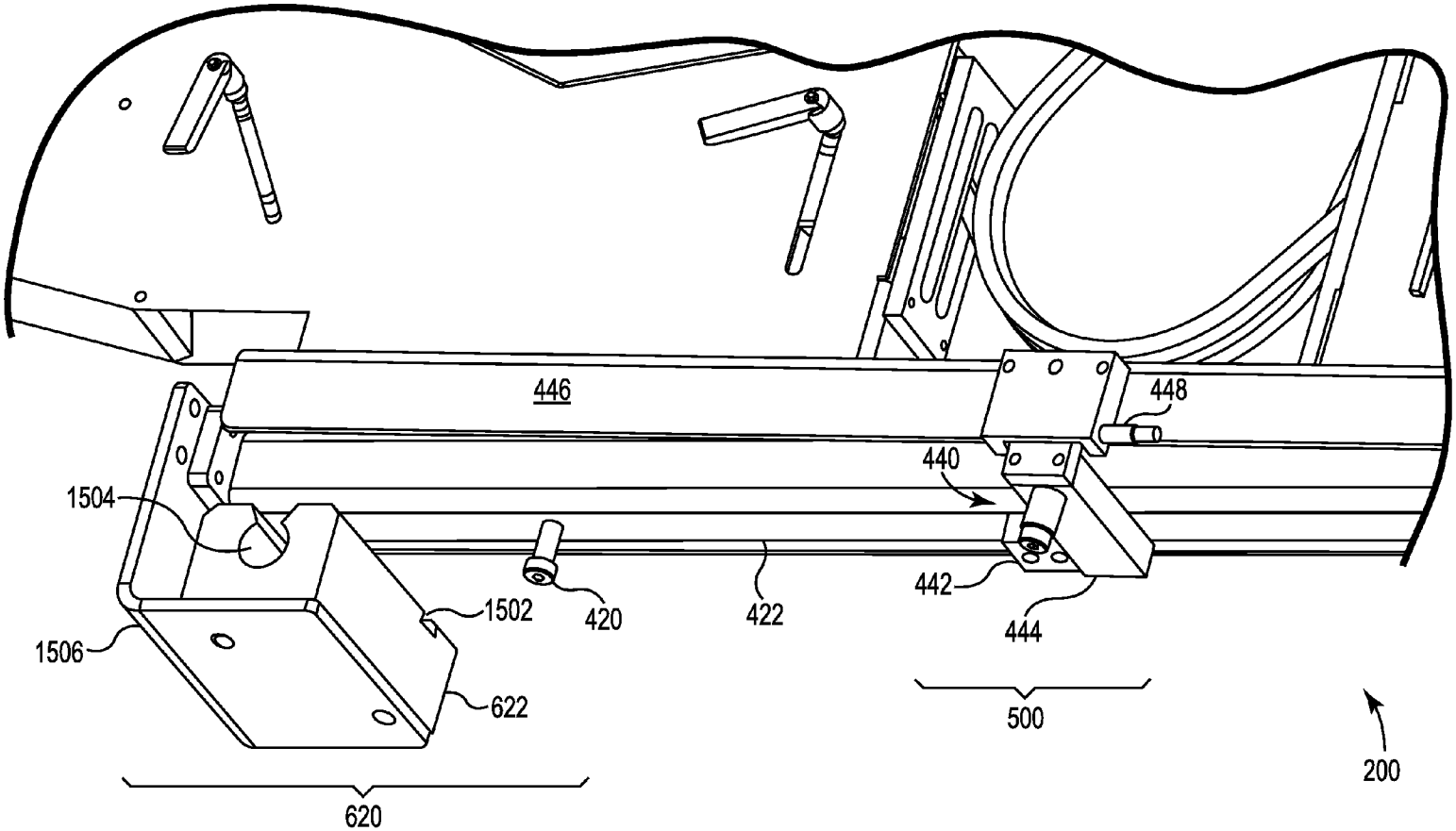
FIG. 17 shows a conceptual drawing of an isometric view of a bottom of a trim arm.

FIG. 17 shows a conceptual drawing of an isometric view of a bottom of a trim arm.

Similar to the FIG. 16, the bottom of the trim arm 200 can include the internal metal rod 422, the external metal tube 446, the trim arm skew lock 500 (as also described and shown herein, such as with respect to FIG. 14), and the arm spacing assembly 620 (as also described and shown herein, such as with respect to FIG. 15).

The trim arm skew lock 500 can include the skew adjust pin 440, the arm skewing anchor 442, the skewing element 444, and the skewing lock spring 448, as also described and shown herein, such as with respect to FIG. 14.

The arm spacing assembly 620 can include the arm spacing pin 420, the arm spacing bearing 622, the spacing pin notch 1502, the rail holder notch 1504, and the assembly support piece 1506, as also described and shown herein, such as with respect to FIG. 15.

The figure also shows other and further elements, as otherwise and further described herein.

Alternative Embodiments

Elements of the system are described herein with respect to one or more possible embodiments, and are not intended to be limiting in any way. In the context of the invention, there is the particular requirement for any such limitations as described with respect to any elements of the system. For example, individual elements of the system 100 could be replaced with substitutes that perform similar functions. Moreover, as described herein, many individual elements of the system are optional, and are not required for operation.

Although the one or more control elements of the system are described herein as being executed as if on a single computing device, in the context of the invention, there is no particular requirement for any such limitation. For example, the one or more control elements of the system can include more than one computing device, not necessarily all similar, on which the element's functions are performed.

Certain aspects of the embodiments described in the present disclosure may be provided as a computer program product, or software, that may include, for example, a computer-readable storage medium or a non-transitory machine-readable medium having stored thereon instructions, which may be used to program a computer system (or other electronic devices) to perform a process according to the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular embodiments. Functionality may be separated or combined in procedures differently in various embodiments of the disclosure or described with different terminology. These and other variations, modifications, additions, and improvements may fall within the scope of the disclosure and the inventive subject matter.

The invention claimed is:

1. An apparatus, comprising at least one trim arm disposed substantially in a linear direction;

an arm spacing assembly configured to adjustably couple to the trim arm at a first point along the trim arm so as to anchor the first point of the trim arm at a fixed lateral position; and a skew lock configured to adjustably couple to the trim arm at second point along the trim arm so as to restrict angular movement of the trim arm at the second point with respect to the first point.

2. The apparatus of claim 1, further comprising a positioning rail disposed substantially transverse to the trim arm; and a positioning shuttle movable along the positioning rail so as to align with the trim arm, the positioning shuttle configured to be further moveable along the trim arm to adjust the arm spacing assembly and the skew lock.

3. The apparatus of claim 2, further comprising one or more moveable cylinders that actuate to move the positioning shuttle along the trim arm.

4. The apparatus of claim 2, further comprising a control element configured to automatically adjust the arm spacing assembly and the skew lock through control inputs that cause the positioning shuttle to move along the positioning rail and along the trim arm.

5. The apparatus of claim 2, wherein the arm spacing assembly includes an anchor rail disposed substantially transverse to the trim arm; and a trim arm anchor movable along the rail so as to set the lateral position of the trim arm.

6. The apparatus of claim 5, wherein the positioning shuttle moves along the trim arm to engage the trim arm anchor and moves along the positioning rail to move the trim arm anchor relative to the anchor rail.

7. The apparatus of claim 5, wherein the arm spacing assembly includes an inflatable frictional element that when inflated holds the trim anchor in a fixed position relative to the anchor rail.

8. The apparatus of claim 7, wherein the inflatable frictional element is deflated when the positioning shuttle moves along the trim arm to engage the trim arm anchor.

9. The apparatus of claim 2, wherein the skew lock includes an arm skewing anchor coupled to a first trim arm component; and a skewing element coupled to a second trim arm component; wherein angular movement of the trim arm is due to relative movement between the first trim arm component and the second trim arm component; and the arm skewing anchor and the skewing element engage to lock the angular position on the trim arm.

10. The apparatus of claim 9, wherein the positioning shuttle moves along the trim arm to engage the arm skewing anchor and pivots about a pivot point to move the first trim arm component relative to the second trim arm component.

11. The apparatus of claim 9, wherein the positioning shuttle moves along the trim arm to engage the arm skewing anchor and moves the arm skewing anchor along an angled surface of positioning shuttle to move the first trim arm component relative to the second trim arm component.

12. The apparatus of claim 9, wherein the first trim arm component includes a metal rod;

the second trim arm component includes a metal tube; and the metal rod is disposed within the metal tube.

13. The apparatus of claim 9, wherein the skew lock further includes one or more springs that hold a surface of the arm skewing anchor against a surface of the skewing element when the skew lock is in a locked position.

14. The apparatus of claim 13, wherein the surface of the arm skewing anchor and the surface of the skewing element have matching teeth that engage when the skew lock is in the locked position.

15. A method of adjusting a trim arm assembly, comprising electronically detecting a location of a trim arm;

anchoring a first point on the trim arm at a first location in response to the operation of electronically detecting; and positioning the trim arm at a selected angle.

16. The method of claim 15, wherein the operation of anchoring includes positioning the first point on a rail, the rail being disposed transverse to the trim arm; and positioning an object that restricts transverse movement of the first point.

17. The method of claim 16, wherein the operation of positioning an object includes inflating a frictional element that restricts movement of the trim arm at the first point.

18. The method of claim 15, wherein the operation of positioning includes selecting a second point on the trim arm;

positioning the second point at a selected angle with respect to the first point; and positioning a frictional element that restricts angular movement of the second point.

19. The method of claim 18, wherein the operation of positioning a frictional element includes engaging a surface of an arm skewing anchor with a surface of a skewing element so as to prevent angular movement between a first trim arm component and a second trim arm component.

20. A method of adjusting a trim arm assembly, comprising electronically detecting a location of a trim arm;

directing a device to the location of the trim arm;

moving the device along the trim arm, wherein the trim arm is positioned on a rail, the rail being transverse to the trim arm;

moving a surface into contact with the trim arm, wherein the trim arm is frictionally restricted from transverse movement;

moving the device along the trim arm, wherein a spring in the trim arm releases the trim arm to angular movement;

moving the trim arm to a selected angle with respect to the rail;

releasing the spring, wherein the trim arm is restricted from angular movement.

* * * * *